US007530684B2

(12) United States Patent
Yamanobe

(10) Patent No.: US 7,530,684 B2
(45) Date of Patent: May 12, 2009

(54) INKJET RECORDING APPARATUS

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 463 days.

(21) Appl. No.: 11/330,092

(22) Filed: Jan. 12, 2006

(65) Prior Publication Data

US 2006/0158494 A1 Jul. 20, 2006

(30) Foreign Application Priority Data

Jan. 14, 2005 (JP) ..... 2005-008145

(51) Int. Cl.
*B41J 2/17* (2006.01)

(52) U.S. Cl. ..... 347/96; 347/100

(58) Field of Classification Search ..... 347/100, 347/95, 96, 101; 106/31.6, 31.13, 31.27; 523/160

See application file for complete search history.

(56) References Cited

U.S. PATENT DOCUMENTS 6,341,858 B1 1/2002 Saijo
6,350,022 B1 2/2002 Takemura et al.
6,439,708 B1 * 8/2002 Kato et al. ..... 347/96
6,739,714 B2 5/2004 Saijo

FOREIGN PATENT DOCUMENTS

JP 8-72234 A 3/1996
JP 9-193367 A 7/1997

* cited by examiner

*Primary Examiner*—Manish S Shah
(74) *Attorney, Agent, or Firm*—Birch, Stewart, Kolasch & Birch LLP

(57) ABSTRACT

The inkjet recording apparatus includes: an ink ejection head which forms a desired image by ejecting an ink toward a recording medium; a treatment liquid ejection head which deposits a treatment liquid on the recording medium by ejecting the treatment liquid toward the recording medium, the treating liquid reacting with the ink on the recording medium; a treatment liquid application device which deposits the treatment liquid on the recording medium by applying the treatment liquid to the recording medium; and a treatment liquid deposition control device which controls so that the treatment liquid is deposited on the recording medium by using at least one of the treatment liquid ejection head and the treatment liquid application device.

19 Claims, 11 Drawing Sheets

INKJET RECORDING APPARATUS

BACKGROUND OF THE INVENTION

1. Field of the Invention

The present invention relates to an inkjet recording apparatus, and more particularly to image recording (forming) technology for recording (forming) an image on a recording medium by reacting ink with a treatment liquid to fix the ink onto the recording medium.

2. Description of the Related Art

In recent years, inkjet recording apparatuses have come to be used widely as data output apparatuses for outputting images, documents, or the like. By driving recording elements, such as nozzles, provided in a recording head in accordance with data, an inkjet recording apparatus is able to form an image, document, or the like, corresponding to data, onto a recording medium, by means of ink ejected from the nozzles.

In an inkjet recording apparatus, in order to improve the quality of the printed image, the dot size and the dot pitch are decided in such a manner that micro-size dots are formed at high density on the medium, and mutually adjacent dots overlap with each other in an image formed by dots at high density. Moreover, in a color image, ink droplets of a plurality of colors are successively superimposed on each other before becoming fixed in the medium. When a plurality of dots are mutually superimposed on each other in this way, there may be occurrence of density non-uniformities, or bleeding (between colors), or the like, due to landing interference in which ink droplets combine together during landing onto the medium. Non-uniformity and bleeding of this kind may cause a notable decline in the quality of the printed image, and may make it impossible to obtain a satisfactory (desired) image.

In order to obtain a desirable image without a decline in the quality of the printed image, a method is proposed that coloring materials (ink substrates) contained in the ink is fixed onto the medium (or the coloring materials agglutinate together) by ejecting ink droplets after a treatment liquid comprising a cationic polymer (polyallylamine, polyamine sulfone, polyvinylamine, chitosan, and neutralized products thereof), or an anionic polymer (polyacrylate, shellac, styrene-acrylate copolymer, styrene-maleic anhydride copolymer, or the like) is deposited on the medium, thereby preventing bleeding or landing interference of the ink.

In an image forming apparatus and an image forming method which are described in Japanese Patent Application Publication No.9-193367, in order to shorten the time period from the application of treatment liquid until the ejection of ink droplets, a coating roller for applying the treatment liquid in a contactable condition toward the recording medium prior to ink ejection is provided in the carriage for moving the inkjet recording head relatively with respect to the recording medium.

Furthermore, in an inkjet recording apparatus described in Japanese Patent Application Publication No. 8-72234,a plurality of recording heads are provided for capable of ejecting ink and treatment liquid independently, and the heads for ejecting droplets of treatment liquid are provided at the respective ends of the heads for ejecting ink so that the ejection of treatment liquid is always performed before the ejection of ink, and the time period from the ejection of droplets of treatment liquid until the ejection of droplets of ink is shortened.

Generally, in order to deposit treatment liquid onto a recording medium, there is a method in which treatment liquid is applied to an entire surface by means of a coating roller or the like, and a method in which droplets of treatment liquid are ejected by means of a print head (ejection), similarly to ink. However, in the method in which the treatment liquid is applied by using a coating roller or the like, since the treatment liquid is applied to regions where ink droplets are not to be ejected, the treatment liquid remains on the medium even after printing has completed (after the end of droplet ejection), and then the burden of solvent processing for removing the surplus treatment liquid, and the like, is increased. In particular, when using a non-permeable medium, such the problem is notable.

On the other hand, in the method in which droplets of treatment liquid are ejected by using a print head, especially in the case of using a permeable type of medium, when the droplets of ink are ejected from a head positioned further downstream, the treatment liquid have already permeated into the medium. Therefore, a reaction between the ink and the treatment liquid may not be achieved.

In the technologies which are disclosed with respect to the image forming apparatus and image forming method described in Japanese Patent Application Publication No. 9-193367 and the inkjet recording apparatus described in Japanese Patent Application Publication No. 8-72234,it is not sufficient to resolve the various problems that may occur depending on conditions such as the type of medium, the image contents, the ink droplet ejection volume, and the like.

SUMMARY OF THE INVENTION

The present invention was devised in view of the foregoing circumstances, and object thereof being to provide an inkjet recording apparatus that can obtain a desirable image by reliable reaction of an ink and a treatment liquid, regardless of conditions such as the type of medium.

In order to attain the aforementioned object, the present invention is directed to an inkjet recording apparatus comprising: an ink ejection head which forms a desired image by ejecting an ink toward a recording medium; a treatment liquid ejection head which deposits a treatment liquid on the recording medium by ejecting the treatment liquid toward the recording medium, the treating liquid reacting with the ink on the recording medium; a treatment liquid application device which deposits the treatment liquid on the recording medium by applying the treatment liquid to the recording medium; and a treatment liquid deposition control device which controls so that the treatment liquid is deposited on the recording medium by using at least one of the treatment liquid ejection head and the treatment liquid application device.

According to the present invention, in an inkjet recording apparatus which fixes an ink onto a recording medium by the reaction of a treatment liquid and the ink, since both a treatment liquid ejection head which ejects the treatment liquid onto the recording medium and a treatment liquid application device which applies the treatment liquid are provided, it is possible to achieve desirable deposition of the treatment liquid on the recording medium by using those two devices selectively in accordance with various conditions, appropriately.

When the treatment liquid ejection head is used, a micro-amount of treatment liquid can be deposited on the recording medium. When the treatment liquid application device is used, a large amount of treatment liquid can be deposited on a broad region of the recording medium, by means of a single application. Therefore, by using these devices selectively, it is possible to respond to various conditions.

In the present specification, the term "image" may include digital images or photographs captured by a digital camera or digital video camera, or images which are not pictures, such as line images, documents, or the like, and it may also include a combination thereof.

Modes of switching selectively the treatment liquid ejection head and the treatment liquid application device may include a mode in which the treatment liquid application device and the treatment liquid ejection head are used conjointly, and also may include a mode in which neither the treatment liquid application device nor the treatment liquid ejection head are used.

Each of the ink ejection head and the treatment liquid ejection head may be a line head in which an ejection aperture row arranging a plurality of ejection apertures for ejecting the ink or treatment liquid has a length corresponding to the image recording width of the recording medium, or may be a serial head in which a short head having a length which does not reach the image recording width of the recording medium is scanned into the direction of the image recording width in the recording medium.

The line-type ejection head may be formed to a length corresponding to the full width of the recording medium by joining together short heads having rows of ejection apertures which do not reach a length corresponding to the full width of the recording medium, in a staggered matrix fashion.

Furthermore, in the ink ejection head and treatment liquid ejection head, a method may be used in which an ejection force is applied to the ink or treatment liquid by means of a piezoelectric actuator (actuator) made of lead zirconate titanate ($Pb(ZrTi)O_3$) (PZT). Moreover, a method may be used in which an ejection force is applied to the ink or treatment liquid by means of a bubble generated by heating the ink or treatment liquid using a heating device such as a heater provided in the ink chamber (pressure chamber) which accumulates ink.

Moreover, the "recording medium" is a medium which receives image recording by means of an inkjet head and treatment liquid ejection head, and includes continuous paper, cut paper, seal paper, resin sheets such as sheets used for overhead projectors (OHP), film, cloth, and various other types of medium without regard to materials or shapes.

The present invention is also directed to the inkjet recording apparatus further comprising a recording medium determination device which determines a type of the recording medium, wherein the treatment liquid deposition control device controls according to the type of the recording medium determined by the recording medium determination device so that the treatment liquid is deposited on the recording medium by using the at least one of the treatment liquid ejection head and the treatment liquid application device.

According to the present invention, since a composition is adopted in which the treatment liquid ejection head and the treatment liquid application device are used selectively in accordance with the determined type of recording medium, it is possible to achieve a desirable deposition of the treatment liquid in accordance with the type of recording medium.

The permeation speed (permeation time) of the treatment liquid varies depending on the type of recording medium. Therefore, when using a permeable type of medium having a fast permeation speed, the control is implemented to select the treatment liquid application device which is capable of depositing a large amount of treatment liquid on the recording medium. On the other hand, when using a non-permeable type of medium having a slow permeation speed (or where the liquid does not permeate at all), the control is implemented in order to select the treatment liquid ejection head which is capable of depositing a small amount of treatment liquid on the recording medium.

Modes of determining the type of recording medium by the recording medium determination device include a mode in which the operator (user) inputs information directly, or a mode of determining the type of recording medium automatically according to the results of reading the recording medium directly by means of a determination device such as a sensor or imaging element. Furthermore, it is also possible to adopt a composition in which an information recording body (a memory, an IC tag, or the like) which stores information including information on the recording medium is provided in the supply device supplying the recording medium, in such a manner that the type of recording medium (medium type) is read in from this information recording body.

The present invention is also directed to the inkjet recording apparatus further comprising an image content determination device which determines a content of the image to be formed on the recording medium, wherein the treatment liquid deposition control device controls according to the content of the image determined by the image content determination device so that the treatment liquid is deposited on the recording medium by using the at least one of the treatment liquid ejection head and the treatment liquid application device.

According to the present invention, since a composition is adopted in which the treatment liquid ejection head and treatment liquid application device are used selectively in accordance with the image content determined by the image contact determination device, it is possible to achieve a desirable deposition of the treatment liquid in accordance with the image content.

The term "image content (object to be printed)" includes a photograph, picture, line image, text characters, symbols, or the like. When ink dots are to be formed at a high density, as in the case of a photographic image, it is preferable that treatment liquid is deposited on the recording medium by using the treatment liquid application device. On the other hand, when the ink dots are to be formed at the low density, as in the case of text or the like, it is preferable that treatment liquid is deposited on the recording medium by using the treatment liquid ejection head.

Modes of determining the image content by the image content determination device involve a mode in which the operator inputs information directly, or a mode of determining the image content automatically according to the file format of the image data, information appended to the image data, and the like.

The present invention is also directed to the inkjet recording apparatus further comprising an ink ejection volume determination device which determines a volume of the ink to be ejected toward the recording medium, wherein the treatment liquid deposition control device controls according to the volume of the ink determined by the ink ejection volume determination device so that the treatment liquid is deposited on the recording medium by using the at least one of the treatment liquid ejection head and the treatment liquid application device.

According to the present invention, since a composition is adopted in which the treatment liquid ejection head and the treatment liquid application device are used selectively in accordance with the ink ejection volume determined by the ink ejection volume determination device, it is possible to achieve desirable deposition of the treatment liquid in accordance with the volume of ink ejection.

As modes in which the treatment liquid ejection head and the treatment liquid application device are used selectively in accordance with the ink ejection volume, there is a mode in which the ink ejection volume is compared with a previously established threshold value. In this mode, when the ink ejection volume is greater than the threshold value, the treatment liquid application device is used. On the other hand, when the ink ejection volume is smaller than the threshold value, the treatment liquid ejection head is used. Furthermore, it is also possible to set a plurality of threshold values to switch selectively according to variations of the ink ejection volume between a combined use of the treatment liquid ejection head and the treatment liquid application device, a use of the treatment liquid application device only, a use of the treatment liquid ejection head only, and no deposition of the treatment liquid.

The present invention is also directed to the inkjet recording apparatus further comprising a region setting device which sets a plurality of regions on the recording medium, wherein the treatment liquid deposition control device controls so that the treatment liquid is deposited by using the at least one of the treatment liquid ejection head and the treatment liquid application device for each of the regions set by the region setting device.

According to the present invention, since it is possible to switch selectively between a treatment liquid application device and a treatment liquid ejection head in accordance with the conditions in a plurality of regions which are set on the recording medium, then the deposited amount of treatment liquid can be controlled finely in accordance with the conditions for each of the respective regions.

By determining the image contents and the ink ejection volume in the regions which are set on the recording medium, the treatment liquid application device and treatment liquid ejection head are switched selectively in accordance with these conditions.

In modes in which a plurality of regions are set on the recording medium, it is preferable that the treatment liquid application device is constituted by a plurality of treatment liquid application members which correspond to the size of the respective regions.

The present invention is also directed to the inkjet recording apparatus wherein a property of the treatment liquid ejected by the treatment liquid ejection head is different from a property of the treatment liquid applied by the treatment liquid application device.

According to the present invention, if a composition is adopted in which a property of the treatment liquid ejected from the treatment liquid ejection head is different from that of the treatment liquid applied by the treatment liquid application device, then it is possible to ensure stable application of the treatment liquid to the recording medium and ejection of the treatment liquid onto the recording medium. In this case, the treatment liquid supply system which supplies treatment liquid to the treatment liquid ejection head, and the treatment liquid supply system which supplies treatment liquid to the treatment liquid application device may be provided separately. Furthermore, a common treatment liquid supply system may be provided, and a device for changing the properties may be provided between the treatment liquid supply system and either the treatment liquid ejection head or the treatment liquid application device.

The present invention is also directed to the inkjet recording apparatus wherein the property of the treatment liquid includes at least one of a density of a reactive material contained in the treatment liquid, a viscosity of the reactive material contained in the treatment liquid, and a surface tension of the treatment liquid.

According to the present invention, it is possible to achieve desirable deposition of the treatment liquid in accordance with the density, viscosity, and surface tension of the reactive material in the treatment liquid.

The present invention is also directed to the inkjet recording apparatus wherein the density of the treatment liquid applied by the treatment liquid application device is greater than the density of the treatment liquid ejected by the treatment liquid ejection head.

According to the present invention, if the density of the reactive material is increased, then the viscosity of the treatment liquid becomes higher. If a treatment liquid of high viscosity is ejected from the treatment liquid ejection head, then ejection abnormalities such as ejection volume abnormalities, ejection position abnormalities, ejection failures, and the like, become more liable to occur. Therefore, it is possible to achieve reliable deposition of the treatment liquid on the recording medium, by using a treatment liquid application device for treatment liquid which has a high density.

The present invention is also directed to the inkjet recording apparatus wherein the viscosity of the treatment liquid applied by the treatment liquid application device is greater than the viscosity of the treatment liquid ejected by the treatment liquid ejection head.

According to the present invention, since the treatment liquid having a low viscosity is used as the treatment liquid ejected from the treatment liquid ejection head, then it is possible to achieve stable ejection of treatment liquid from the treatment liquid ejection head.

In this case, a composition may be adopted so that the viscosity of the treatment liquid inside the treatment liquid ejection head is kept to a uniform value by controlling the temperature of the treatment liquid in the treatment liquid ejection head.

The present invention is also directed to the inkjet recording apparatus wherein the surface tension of the treatment liquid ejected by the treatment liquid ejection head is greater than the surface tension of the treatment liquid applied by the treatment liquid application device.

According to the present invention, since a treatment liquid having a lower surface tension is used as the treatment liquid applied by the treatment liquid application device, then it is possible to achieve a stable application of treatment liquid to the recording medium.

As described above, according to the present invention, since the inkjet recording apparatus comprises a treatment liquid ejection head which ejects the treatment liquid onto the recording medium, and a treatment liquid application device which applying the treatment liquid to the recording medium, it is possible to switch selectively between ejection and application according to the conditions, and then desirable deposition of the treatment liquid (application and ejection) on the recording medium can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
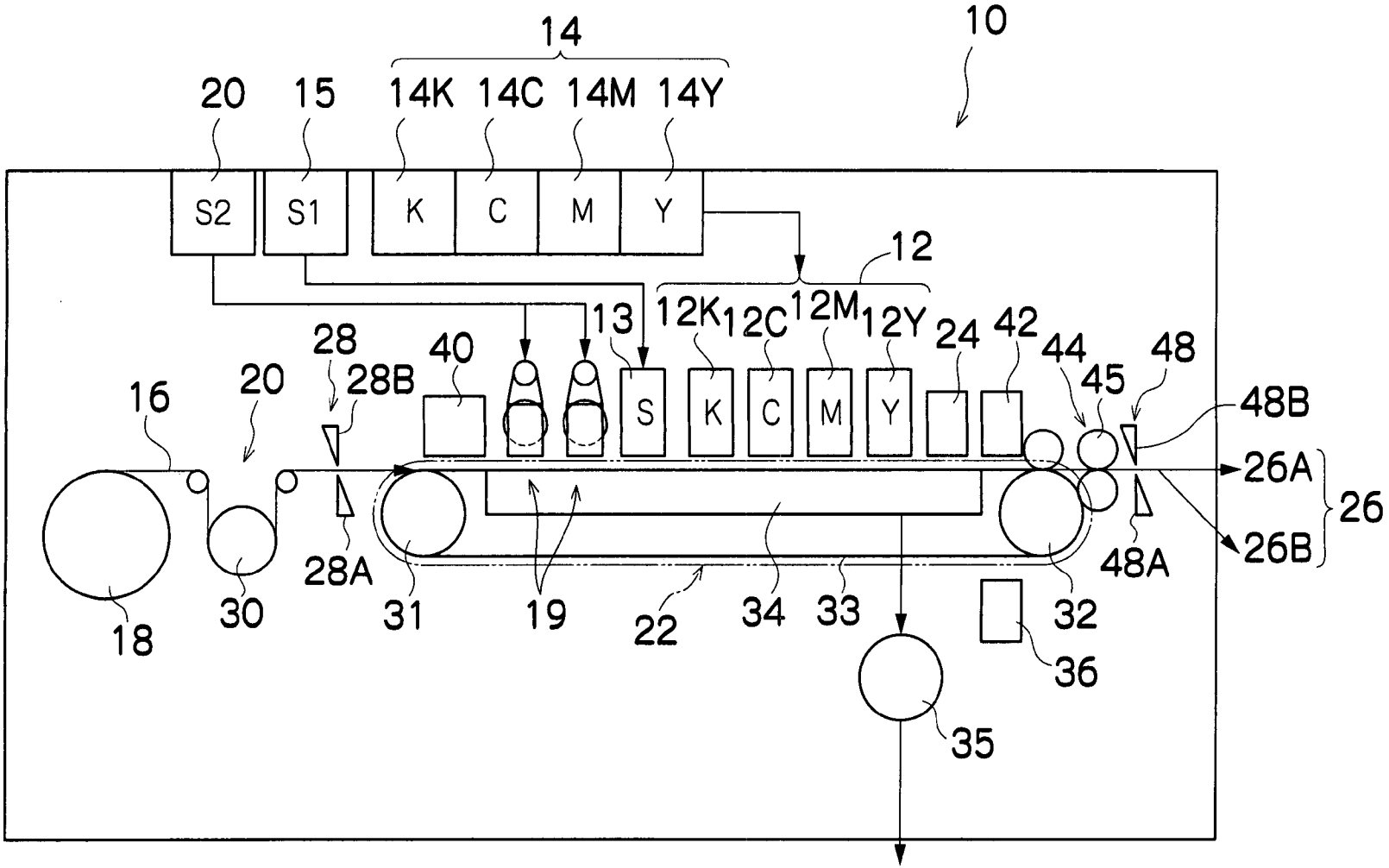
FIG. 1 is a general schematic drawing of an inkjet recording apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of print heads 12K, 12C, 12M and 12Y provided respectively for each of a plurality of inks, black (K), cyan (C), magenta (M) and yellow (Y); a treatment liquid ejection head 13 provided to correspond to a treatment liquid S(S1) for promoting the fixing of the ink by reacting with the ink ejected from the print heads 12K, 12C, 12M and 12Y; an ink storing and loading unit 14 for storing ink to be supplied to the print heads 12K, 12C, 12M and 12Y corresponding to the respective colored inks; a treatment liquid storing and loading unit 15 for storing a treatment liquid S (S1) to be supplied to the treatment liquid ejection head 13; a paper supply unit 18 for supplying recording paper 16 forming a recording medium; a treatment liquid application unit 19 for applying a treatment liquid S (S2) to the recording paper 16; a treatment liquid storing and loading unit 20 for storing treatment liquid S (S2) to be loaded into the treatment liquid application unit 19; a suction belt conveyance unit 22 disposed facing the ink ejection surface of the print head 12K, 12C, 12M and 12Y, for conveying the recording paper 16 while keeping the recording paper 16 flat; and a paper output unit 26 for outputting image-printed recording paper 16 (printed matter).

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper 16 can be used, it is preferable that an information recording medium such as a bar code and a wireless tag containing information about the type of recording paper 16 is attached to the magazine, and by reading the information contained in the information recording medium with a predetermined reading device, the type of recording paper 16 to be used is automatically determined, and ink-droplet ejection is controlled so that the ink-droplets are ejected in an appropriate manner in accordance with the type of recording paper 16.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
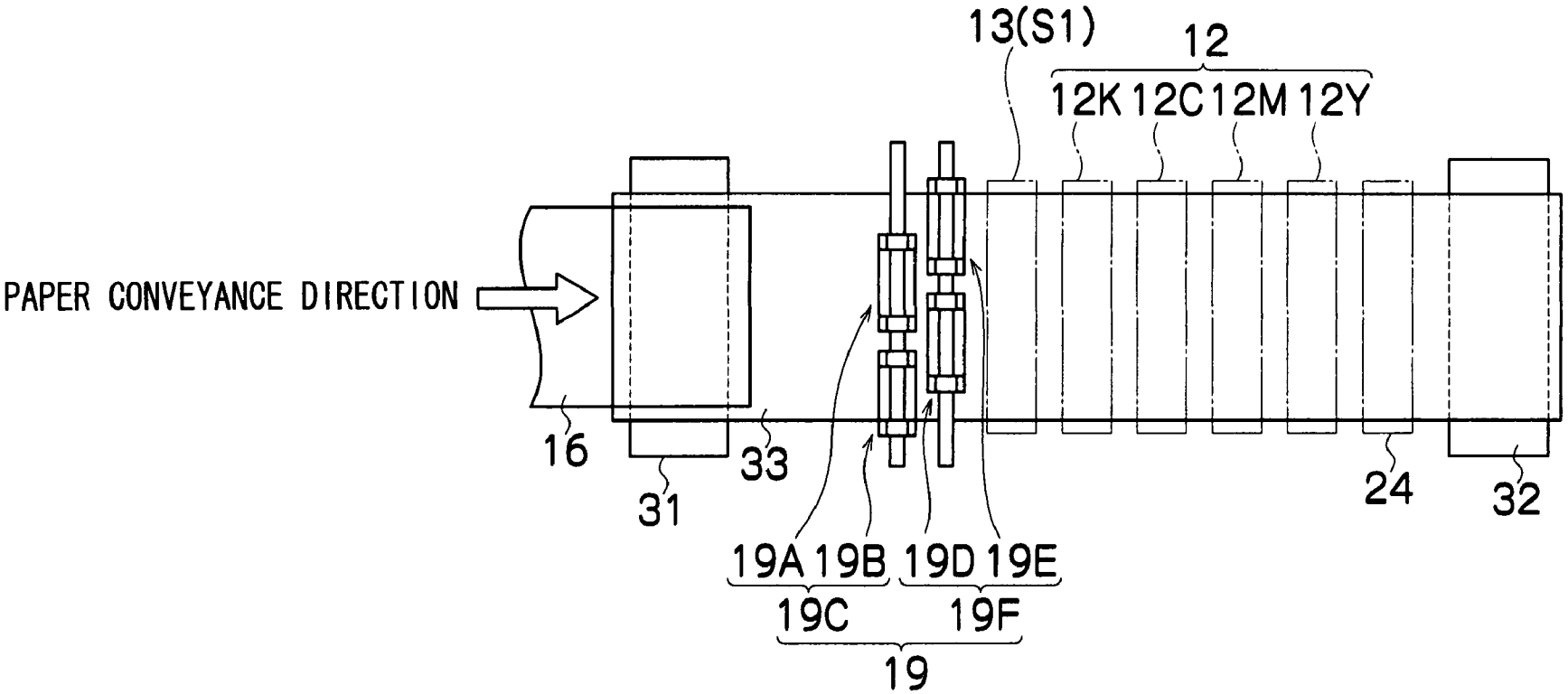
FIG. 2 is a plan view of the principal part of the peripheral area of a printing unit in the inkjet recording apparatus shown in FIG. 1.

The print heads 12K, 12C, 12M and 12Y and the treatment liquid ejection head 13 have the same structure, and those heads 12K, 12C, 12M, 12Y and 13 are so-called "full-line heads" in which a line head having a length corresponding to the maximum paper width is disposed in a perpendicular direction to the paper conveyance direction (see FIG. 2). Although an example of the detailed structure is described below, each of the print heads 12K, 12C, 12M and 12Y and the treatment liquid ejection head 13 is constituted by a line head, in which a plurality of nozzles are arranged along a length that exceeds at least one side of the maximum-size recording paper 16 intended for use in the inkjet recording apparatus 10, as shown in FIG. 2.

The treatment liquid ejection head 13 corresponding to the treatment liquid S (S1) and the print heads 12K, 12C, 12M and 12Y corresponding to the respective colored inks are arranged in the order of black (K), cyan (C), magenta (M), and yellow (Y) from the upstream side, following the conveyance direction of the recording paper 16 (hereinafter, referred to as the paper conveyance direction).

Furthermore, the treatment liquid application unit 19 for applying a treatment liquid S (S2) to the recording paper 16 is provided on the upstream side of the treatment liquid ejection head 13 in the paper conveyance direction. As shown in FIG. 2, the treatment liquid application unit 19 comprises a roller module 19C having two coating rollers 19A and 19B which are aligned in a direction substantially perpendicular to the paper conveyance direction (namely, the main scanning direction), and a roller module 19F having coating rollers 19D and 19E.

The coating rollers 19A, 19B, 19D and 19E are made of porous members such as sponges, and are constituted so that the treatment liquid S is applied to a prescribed region of the recording paper 16 by moving the recording paper 16 in the paper conveyance direction while the coating rollers 19A, 19B, 19D and 19E impregnated with treatment liquid S make contact with the recording paper 16.

Furthermore, since the treatment liquid application unit 19 has a structure in which the coating rollers 19A, 19B, 19D and 19E are arranged in the sub-scanning direction at staggered positions in the main scanning direction, it is possible to apply the treatment liquid S completely to the entire region in the width direction of the recording paper 16, or separately to four regions obtained by dividing the recording paper 16 in the width direction.

In the present embodiment, the porous members are used for the coating rollers 19A, 19B, 19D and 19E, but a composition may be adopted in which the treatment liquid S flows onto the recording paper 16 via the coating rollers made of members such as rubber while the coating rollers rotate in a prescribed direction, for example.

More specifically, each of the coating rollers 19A, 19B, 19D and 19E is provided with a selection mechanism which is not shown in the diagram (for example, a raising and lowering mechanism which allows the clearance or contact pressure of each of the coating rollers 19A, 19B, 19D and 19E with respect to the recording paper 16 to be changed by raising or lowering each of the coating rollers 19A, 19B, 19D and 19E), and the selection mechanism is constituted so as to select whether or not each of the coating rollers is to be made to contact the recording paper 16 according to a command from a system control unit described hereinafter. The raising and lowering mechanism for each of the coating rollers 19A, 19B, 19D and 19E comprises: a motor forming a drive source; a transmission mechanism such as a belt, a pulley, and a gear, which transmits the driving force of the motor; and supporting members such as guides, which support each of the coating rollers 19A, 19B, 19D and 19E, the motor, and the transmission mechanism.

The present embodiment indicates the treatment liquid application unit 19 having the four coating rollers 19A, 19B, 19D and 19E in the main scanning direction (in other words, having a coating roller divided into the four sections in the main scanning direction), but the present invention is not limited to those. More specifically, two or three coating rollers may be provided in the main scanning direction, or five or more coating rollers may be provided in the main scanning direction.

In the composition of this kind, after treatment liquid S has been deposited on the recording paper 16 by means of the treatment liquid ejection head 13 and the treatment liquid application unit 19 while the recording paper 16 is conveyed, colored inks are ejected respectively from the print heads 12K, 12C, 12M and 12Y, thereby forming a color image on the recording paper 16.

The printing unit 12 and the treatment liquid ejection head 13, in which the full-line heads covering the entire width of the recording paper 16 are thus provided for the respective ink colors, can record an image over the entire surface of the recording paper 16 by performing the action of moving the recording paper 16, the printing unit 12, and the treatment liquid ejection head 13 relative to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

The ink storing and loading unit 14 and the treatment liquid storing and loading units 15 and 20 have the same composition. The ink storing and loading unit 14 has ink tanks 60A for storing ink of the colors corresponding to the respective heads 12K, 12C, 12M and 12Y (not shown in FIG. 2, but shown in FIG. 5), and the treatment liquid storing and loading units 15 and 20 have treatment liquid tanks 60B and 60C for storing treatment liquids S (S1 and S2) (not shown in FIG. 2, but shown in FIG. 5). The tanks are connected respectively to the print heads 12K, 12C, 12M and 12Y, the treatment liquid ejection head 13, and the treatment liquid application unit 19 by means of necessary tubing channels 63A, 63B and 63C (not shown in FIG. 2, but shown in FIG. 5).

Furthermore, the ink storing and loading unit 14 and the treatment liquid storing and loading units 15 and 20 also comprise a warning device (display device, alarm sound generating device) for issuing a warning when the remaining amount of ink or treatment liquid S has become low, as well as a mechanism for preventing accidental loading of the wrong color of ink, or confusion between loading of ink and treatment liquid (and between different types of treatment liquid, if different types of treatment liquid are to be loaded into the treatment liquid storing and loading units 15 and 20).

The print determination unit 24 has an image sensor for capturing an image of the print result of the printing unit 12, and functions as a device to check for ejection defects such as clogs of the nozzles in the printing unit 12 from the droplet ejection image read by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of the print heads 12K, 12C, 12M and 12Y and the treatment liquid ejection head 13 will be described. The print heads 12K, 12C, 12M and 12Y of the respective ink colors and the treatment liquid ejection head 13 have the same structure, and a print head 50 as an example of those print heads and treatment liquid ejection head is hereinafter described in details.

Figure 3A:
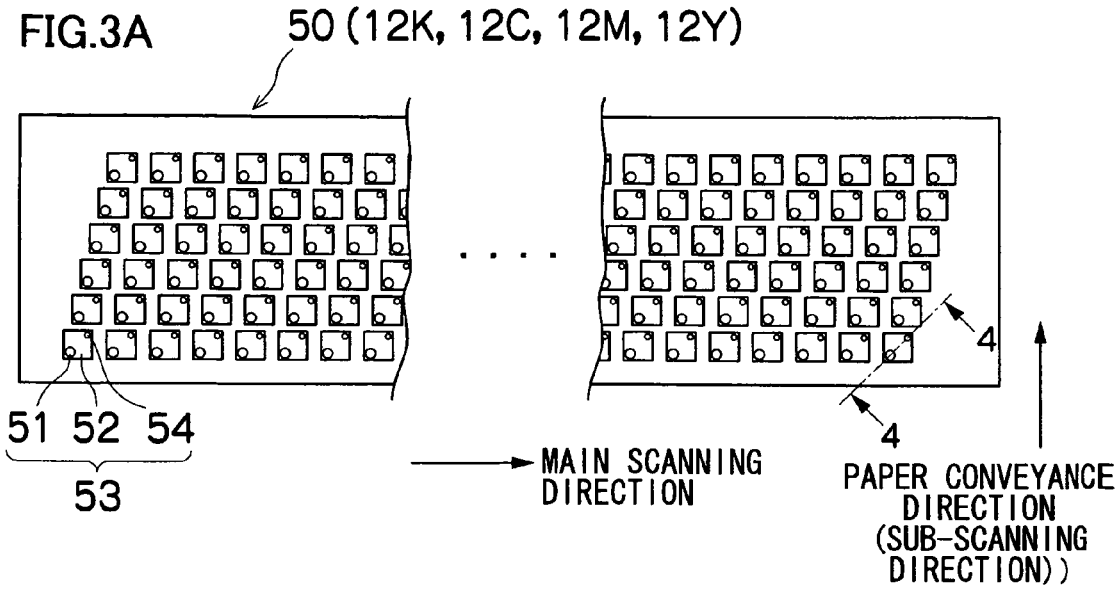
FIG. 3A is a plan view perspective diagram showing an example of a structure of a head.
Figure 3B:
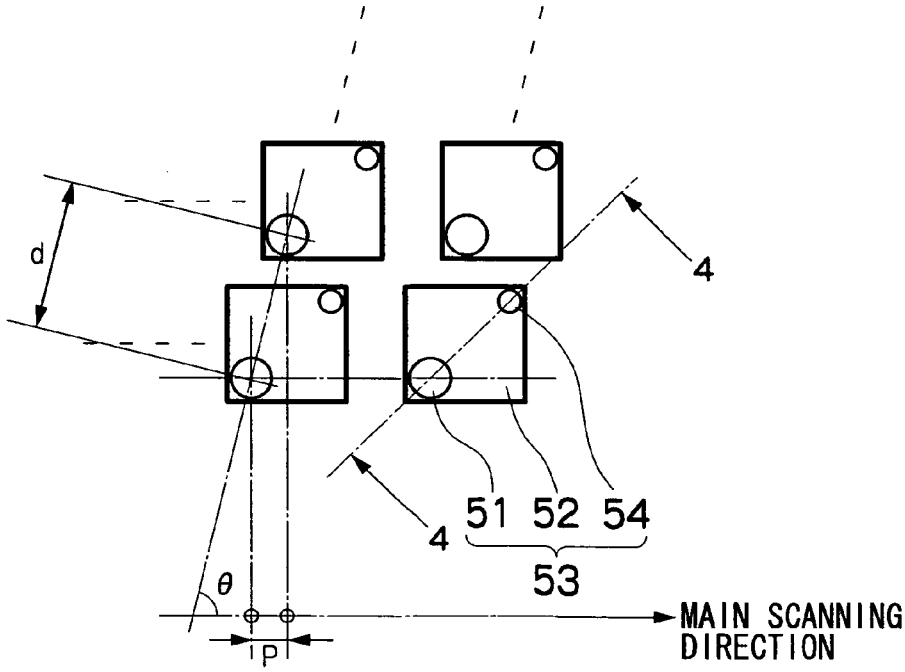
FIG. 3B is an enlarged diagram of same.
Figure 3C:
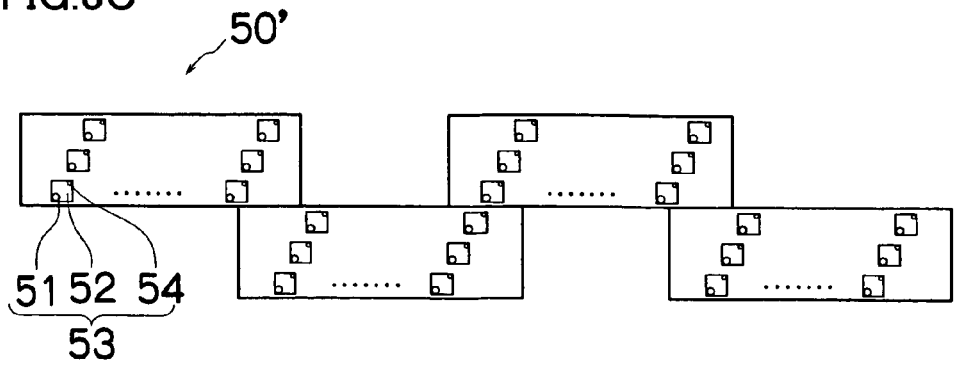
FIG. 3C is a plan view perspective diagram showing a further example of the structure of the head.
Figure 4:
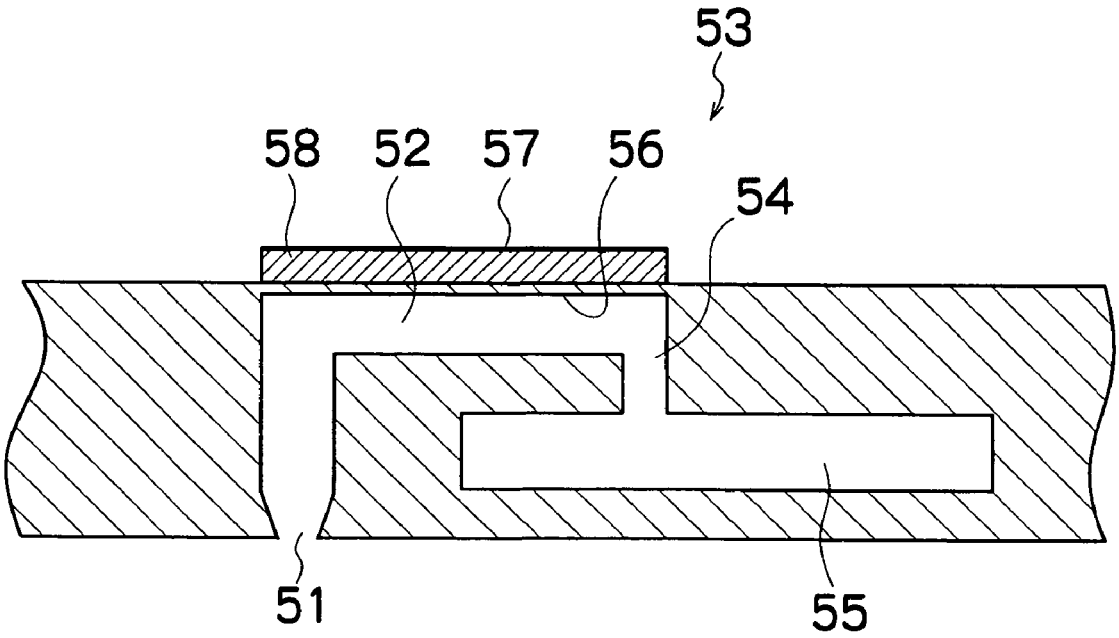
FIG. 4 is a cross-sectional view along a line 4-4 shown in FIGS. 3A and 3B.

FIG. 3A is a plan view perspective diagram showing an example of the structure of the print head 50, and FIG. 3B is an enlarged diagram of same. Furthermore, FIG. 3C is a plan view perspective diagram showing a further example of the composition of the print head 50, and FIG. 4 is a cross-sectional diagram showing a three-dimensional composition of an ink chamber unit, which is a cross-sectional view along a line 4-4 in FIGS. 3A and 3B. In order to achieve a high density of the dots deposited on the surface of the recording medium, it is necessary to achieve a high density of the nozzles in the print head 50. As shown in FIGS. 3A to 3C and FIG. 4, the print head 50 in the present embodiment has a structure in which a plurality of ink chamber units 53 including nozzles 51 for ejecting droplets of the ink and pressure chambers 52 connecting to the nozzles 51 are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width (printable width) of the recording medium in a direction substantially perpendicular to the conveyance direction of the print medium (recording paper 16).

Moreover, as shown in FIG. 3C, it is also possible to use respective heads 50' of nozzles arranged to a short length in a two-dimensional fashion, and to combine same in a zigzag arrangement, whereby a length corresponding to the full width of the recording medium is achieved.

As shown in FIG. 4, the pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via the supply port 54 to a common flow channel 55.

An actuator 58 provided with an individual electrode 57 is bonded to a pressure plate (diaphragm) 56, which forms the upper faces of the pressure chambers 52. When a drive voltage is applied between the individual electrode 57 and a common electrode as which the pressure plate 56 also serves, then the actuator 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. A piezoelectric body (piezoelectric element), such as lead zirconate titanate ($Pb(ZrTi)O_3$) (PZT), is suitable as the actuator 58.

As shown in FIGS. 3A and 3B, the plurality of ink chamber units 53 having this structure are composed in a lattice arrangement, based on a fixed arrangement pattern aligned in a main scanning direction, which is the lengthwise direction of the print head 50, and in a direction oblique to the main scanning direction at a fixed angle of θ. By adopting a structure wherein a plurality of ink chamber units 53 are arranged at a uniform pitch d in a direction having an angle θ with respect to the main scanning direction, the pitch P of the nozzles when projected to an alignment in the main scanning direction will be d×cos θ.

More specifically, the arrangement can be treated equivalently to one in which the respective nozzles 51 are arranged in a linear fashion at uniform pitch P, in the main scanning direction. By means of this composition, it is possible to achieve a nozzle of high density, in which the nozzle columns projected to align in the main scanning direction reach a total of 2400 per inch (2400 nozzles per inch, 2400 dpi). Below, in order to facilitate the description, it is supposed that the nozzles 51 are arranged in a linear fashion at a uniform pitch (P), in the main scanning direction.

In implementing the present invention, the arrangement of the nozzles is not limited to that of the example illustrated in the drawings. Moreover, a method is employed in the present embodiment where an ink droplet is ejected by means of the deformation of the actuator 58, which is typified by a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Description of Ink and Treatment Liquid Supply System

Next, an ink and treatment liquid supply system of the inkjet recording apparatus 10 will be described.

Figure 5:
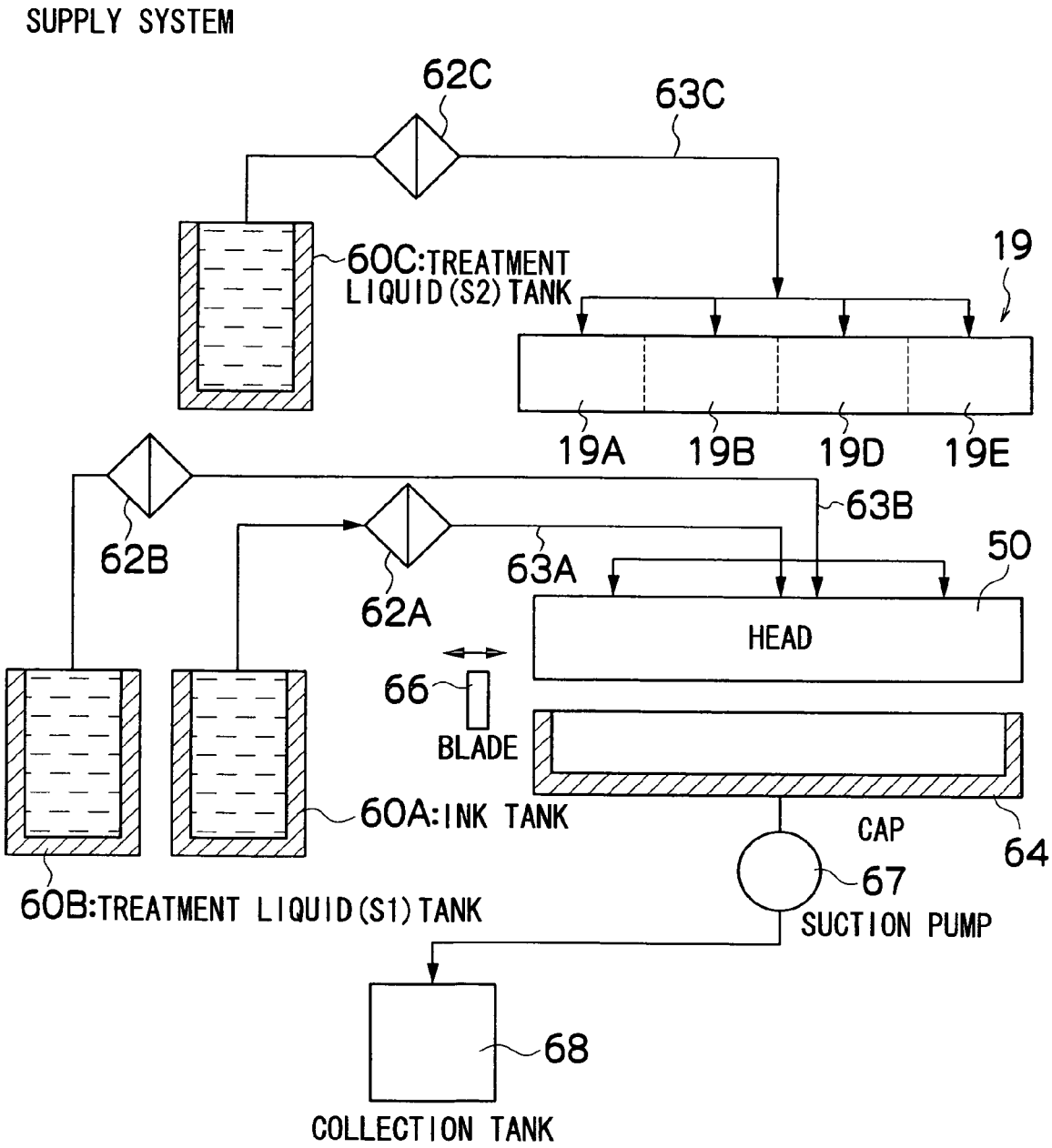
FIG. 5 is a principal block diagram showing configuration of a supply system of the inkjet recording apparatus shown in FIG. 1.

FIG. 5 shows the composition of the supply system provided in the inkjet recording apparatus 10. The supply system shown in FIG. 5 corresponds to the ink storing and loading unit 14 and the treatment liquid storing and loading units 15 and 20 described in FIG. 1.

The supply system shown in FIG. 5 comprises an ink tank 60A, which is a base tank for supplying ink, and base tanks 60B and 60C for supplying treatment liquids S1 and S2. Since the basic composition of the ink tank 60A and the treatment liquid tanks 60B and 60C are the same, then the ink tank 60A is described below. Hereinafter, the term "tank 60" may be used simply to refer generally to the ink tank 60A and the treatment liquid tanks 60B and 60C.

The aspects of the ink tank 60A include a refillable type and a cartridge type: when the remaining amount of ink is low, the ink tank 60A of the refillable type is filled with ink through a filling port (not shown) and the ink tank 60A of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

Furthermore, the ink (or treatment liquid) in the tank 60 is supplied to the head 50 (or the treatment liquid application unit 19) via a prescribed channel passage 63 (the term "channel passage 63" may be used simply to refer generally to the channel passages 63A, 63B and 63C), and a filter 62 (the term "filter 62" may be used simply to refer generally to the filters 62A, 62B and 62C) to eliminate foreign material and air bubbles. The filter mesh size in the filter 62 is preferably equivalent to or less than the diameter of the nozzle and commonly about 20 μm.

If the different treatment liquids S1 and S2 are loaded respectively into the treatment liquid storing and loading units 15 and 20, the filters 62B and 62C having different mesh sizes may be used. For example, in the treatment liquids S1 and S2, if the viscosity of one is greater than that of another, it is preferable that the filter 62 corresponding to the treatment liquid S having the higher viscosity has an increased mesh size.

Although not shown in FIG. 5, it is preferable to provide a sub-tank integrally to the head 50 or nearby the head 50. The sub-tank has a damper function for preventing variation in the internal pressure of the head 50 and a function for improving refilling of the head 50.

The inkjet recording apparatus 10 is also provided with a cap 64 as a device to prevent the nozzles 51 from drying out or to prevent an increase in the viscosity of the ink or treatment liquid S in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

During printing or standby, if the use frequency of a particular nozzle 51 is low, and if a state of not ejecting the ink or treatment liquid S continues for a prescribed time period or more, then the solvent of the ink or treatment liquid in the vicinity of the nozzle evaporates and the viscosity of the ink or treatment liquid S increases. In a situation of this kind, it will become impossible to eject the ink or treatment liquid S from the nozzle 51, even if the actuator 58 is operated.

Therefore, before a situation of this kind develops (namely, while the ink or treatment liquid S is within a range of viscosity which allows it to be ejected by operation of the actuator 58), the actuator 58 is operated, and a preliminary ejection ("purge", "blank ejection", "liquid ejection" or "dummy ejection") is carried out toward the cap 64, in order to expel the degraded ink or treatment liquid S (namely, the ink or treatment liquid S in the vicinity of the nozzle 51 which has increased viscosity).

Furthermore, if air bubbles enter into the ink inside the head 50 (inside the pressure chamber 52), then even if the actuator 58 is operated, it will not be possible to eject the ink or treatment liquid S from the nozzle 51. In a case of this kind, the cap 64 is placed on the head 50, the ink or treatment liquid S (ink or treatment liquid S containing air bubbles) inside the pressure chamber 52 is removed by suction using a suction pump 67, and the ink or treatment liquid S removed by suction are then sent to a collection tank 68.

This suction operation is also carried out in order to remove the degraded ink or treatment liquid S having increased viscosity (hardened ink or treatment liquid S), when the ink or treatment liquid S are loaded into the head 50 for the first time, and when the head 50 starts to be used after having been out of use for a long period of time. Since the suction operation is carried out with respect to all of the ink or treatment liquid S inside the pressure chamber 52, the consumption of ink or treatment liquid S is considerably large. Therefore, preferably, preliminary ejection is carried out when the increase in the viscosity of the ink and the treatment liquid is still minor.

The cleaning blade 66 is composed of rubber or another elastic member, and can slide on the ink ejection surface (surface of the nozzle plate) of the head 50 by means of a blade movement mechanism (wiper) (not shown). When droplets of the ink or treatment liquid S, or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade 66.

In a mode in which a permeable medium is used as the recording paper 16, cockling may occur due to the treatment liquid S remaining on the recording paper 16. Furthermore, when a non-permeable medium is used, the remaining treatment liquid S may be transported around to the rear side of the recording paper 16, thereby soiling the recording paper 16 and the belt 33. In order to avoid such the phenomenon, a treatment liquid recovery mechanism may be provided for recovering the remaining treatment liquid (solvent) from the recording paper 16.

As an example of treatment liquid recovery mechanism, there is a mode in which the treatment liquid S is removed directly by causing a liquid absorbing member to make contact with the recording paper 16, the liquid absorbing member composed of a porous member or the like being provided on the downstream side of the printing unit 12 in terms of the paper conveyance direction. Of course, various other methods may be used instead.

Description of Control System

Figure 6:
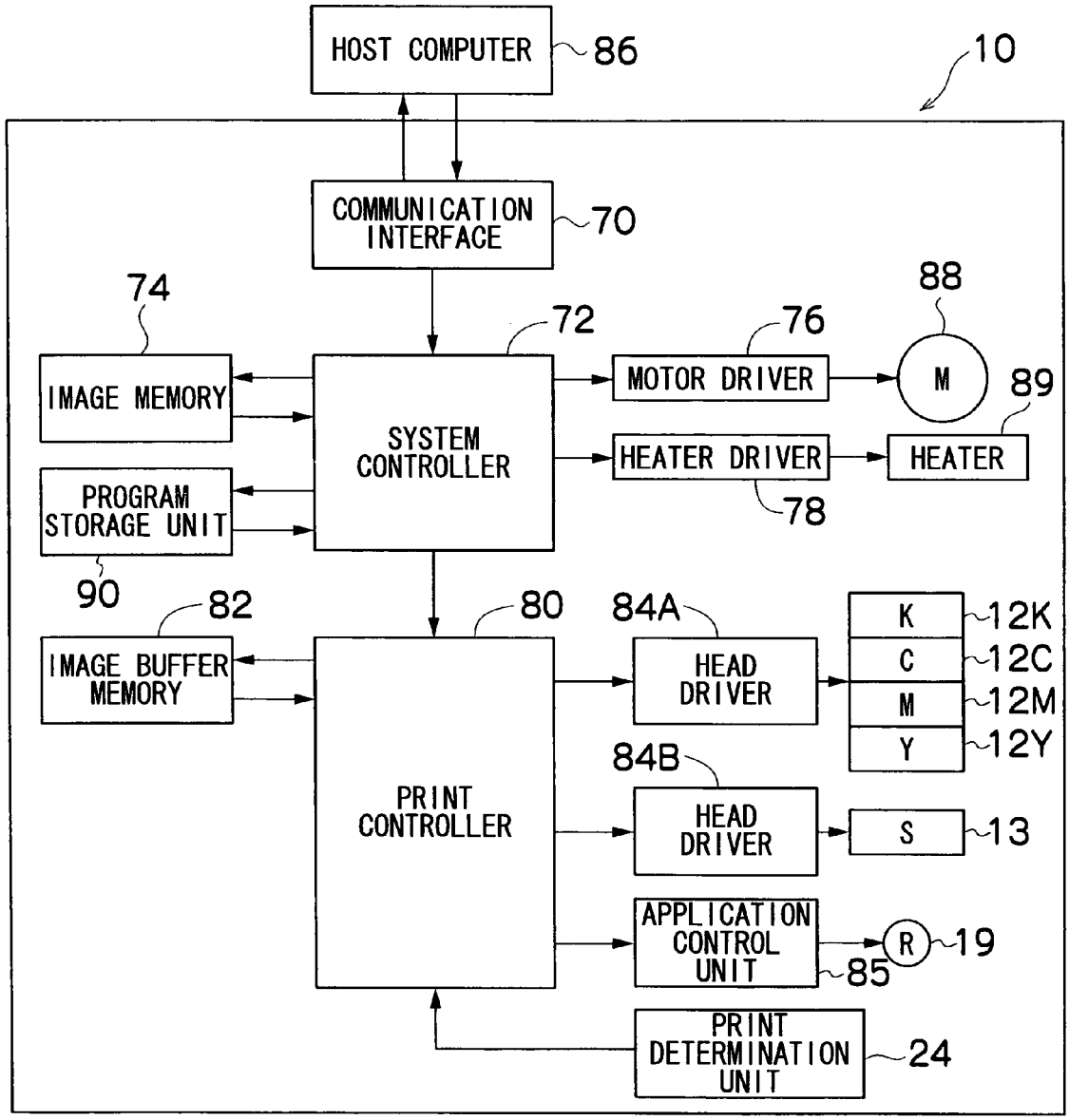
FIG. 6 is a principal block diagram showing a system configuration of the inkjet recording apparatus shown in FIG. 1.

FIG. 6 is a principal block diagram showing a system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, head drivers 84A and 84B, an application control unit 85, and the like.

The communication interface 70 is an interface unit for receiving image data sent from a host computer 86. A serial interface such as USB, IEEE1394,Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images input through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, and the like, as well as controlling communications with the host computer 86 and writing and reading to and from the memory 74, and it also generates control signals for controlling the motor 88 and heater 89 of the conveyance system.

The motor driver 76 drives the motor 88 in accordance with commands from the system controller 72. The heater driver 78 drives the heater 89 of the post-drying unit 42 or the like in accordance with commands from the system controller 72.

The motor 88 shown in FIG. 6 represents a plurality of motors such as a motor which rotates the drum 31 (32) in FIG. 1, and motors used in the raising and lowering mechanisms of the coating rollers 19A, 19B, 19D and 19E. Furthermore, the motor drivers 76 for controlling each of the motors shown as the motor 88 are provided to correspond with the motors. Of course, a plurality of motor drivers may be formed on a single chip.

The print controller 80 is a control unit having a signal processing function for performing various treatment processes, corrections, and the like, in accordance with the control implemented by the system controller 72, in order to generate a signal for controlling printing from the image data in the memory 74. The print controller 80 supplies the print data thus generated to the head drivers 84A and 84B (hereinafter, the term "head driver 84" is used to refer generally to the head drivers 84A and 84B). Prescribed signal processing is carried out in the print controller 80, and the ejection amount and the ejection timing of droplets of the ink or treatment liquid S from the head 50 are controlled via the head driver 84.

Furthermore, the print controller 80 also controls the treatment liquid application unit 19 via the application control unit 85, so as to control the application amount and application timing (application region) of the treatment liquid S applied by the treatment liquid application unit 19, and selection (switching) of the coating rollers 19A, 19B, 19D and 19E.

The application amount of the treatment liquid S can be varied by changing the contact pressure of the coating rollers 19A, 19B, 19D and 19E (the clearance between the coating rollers 19A, 19B, 19D and 19E, and the recording paper 16), or by changing the duration of contact of the rollers. In a mode in which the application amount of the treatment liquid S is controlled by changing the contact duration, then the conveyance speed of the recording paper 16 may be controlled by controlling the speed of movement of the suction belt conveyance unit 22 shown in FIG. 1.

Furthermore, the application timing of the treatment liquid application unit 19 can be controlled by making the coating rollers 19A, 19B, 19D and 19E in contact with the recording paper 16 or not, by raising and lowering the coating rollers 19A, 19B, 19D and 19E according to the application timing.

The inkjet recording apparatus 10 comprises: the treatment liquid ejection head 13 which ejects or sprays droplets of the treatment liquid S toward the recording paper 16, the treatment liquid S reacting with the ink of respective colors ejected as droplets onto the recording paper 16 from the printing unit 12 shown in FIG. 1; and the treatment liquid application unit 19 which applies the treatment liquid S to the recording paper 16. In the print controller 80, the control is implemented in such a manner that the two devices for depositing the treatment liquid S are used selectively in order to deposit the treatment liquid S on the recording paper 16 in a desirable fashion. The details of the ejection control and the application control of treatment liquid S are described hereinafter.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor. The head driver 84 generates drive signals according to print data supplied by the print controller 80 and drives the piezoelectric elements of the print heads 12K, 12C, 12M and 12Y of the respective colors, and the treatment liquid ejection head 13, by means of these drive signals. A feedback control system for maintaining constant drive conditions in the heads may be included in the head driver 84.

The image data to be printed is input from an external source (the host computer 86, for example) via the communication interface 70, and is stored in the memory 74. In this stage, the RGB image data is stored in the memory 74.

The image data stored in the memory 74 is sent to the print controller 80 through the system controller 72, and is converted to the dot data for each ink color and the treatment liquid in the print controller 80. In other words, the print controller 80 performs processing for converting the input RGB image data into dot data for four colors K, C, M and Y, and the treatment liquid S. The dot data generated by the print controller 80 is stored in the image buffer memory 82.

The dot data for the treatment liquid S may be the same as the dot data for the colored inks (KCMY), or may be dot data corresponding to the treatment liquid S only. More specifically, the dot data for the treatment liquid S may correspond respectively to the dot data for the ink, or may be composed so that a plurality of dots formed by the ink correspond to one dot of the treatment liquid S.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be combined with a storage device (memory), which is not shown, for storing operational parameters (system parameters), and the like.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

As required, the print controller 80 makes various corrections with respect to the head 50 according to information obtained from the print determination unit 24.

In the embodiment shown in FIG. 1, the print determination unit 24 is provided on the print surface side, and then the print surface is irradiated with a light source (not illustrated), such as a cold cathode tube disposed in the vicinity of the line sensor, so that the reflected light is read in by the line sensor. However, in implementing the present invention, another composition may be adopted.

Description of Ejection/Application Control of Treatment Liquid

As described above, the inkjet recording apparatus 10 is composed so that bleeding or landing interference of the ink is avoided by ejecting droplets of inks of respective colors onto the recording paper 16 on which the treatment liquid S has been deposited. Moreover, two types of devices, namely, the treatment liquid ejection head 13 and the treatment liquid application unit 19 are provided for depositing treatment liquid on the recording paper 16.

The inkjet recording apparatus 10 is composed so that one of four types of treatment liquid deposition methods (namely, only application, only ejection, both application and ejection, or no deposition of the treatment liquid on the recording paper 16) can be selected by switching selectively between those devices according to selection conditions (described in more detail hereinafter).

The recording paper 16 may be divided into a plurality of regions, and the treatment liquid deposition method may be selected for each of the regions, according to the conditions relating to that region. In the mode in which the treatment liquid is applied by the treatment liquid application unit 19 as shown in FIG. 1, the control is implemented so that one or a plurality of coating rollers 19A, 19B, 19D and 19E corresponding to the region are selected to be brought into contact with (or move to close proximity with) the recording paper 16.

First Embodiment

Next, the first embodiment of the present invention will be described.

In the first embodiment, the type of recording paper 16 is used as the aforementioned selection condition. In other words, the type of recording paper 16 is determined, and according to the determination result, treatment liquid S is deposited on the recording paper 16 by selectively using the treatment liquid ejection head 13 and the treatment liquid application unit 19.

The recording paper 16 used in the inkjet recording apparatus 10 includes permeable papers (permeable medium) such as special inkjet (IJ) paper, normal paper, and recycled paper, and non-permeable papers (non-permeable medium) such as printable art paper, or the like.

In the case of permeable paper, the ink (solvent) permeates into the interior of the recording paper 16, and the coloring material contained in the ink is fixed principally in the interior (image receiving layer) of the recording paper 16, thereby forming the prescribed dots. On the other hand, in the case of a non-permeable paper, the ink does not permeate into the recording paper 16, and the coloring material in the ink is fixed on the surface of the recording paper 16, thereby forming the prescribed dots.

Non-permeable papers may also include papers in which a portion of the ink solvent (generally a micro-amount) permeates into the interior of the paper. In other words, the non-permeable media include a medium which is permeable of a micro-amount of ink solvent or treatment liquid in comparison with the deposited amount thereof, and a medium which has a slow speed of permeation in comparison with permeable media.

The present embodiment indicates a mode in which a type of paper is used as the recording medium on which a prescribed image is formed (recorded) by the ink, but the application according to the present invention is not limited to papers. The present invention may also be applied to a permeable medium such as cloth, or non-permeable medium such as OHP sheets or other resin sheets, films, or the like.

Figure 7:
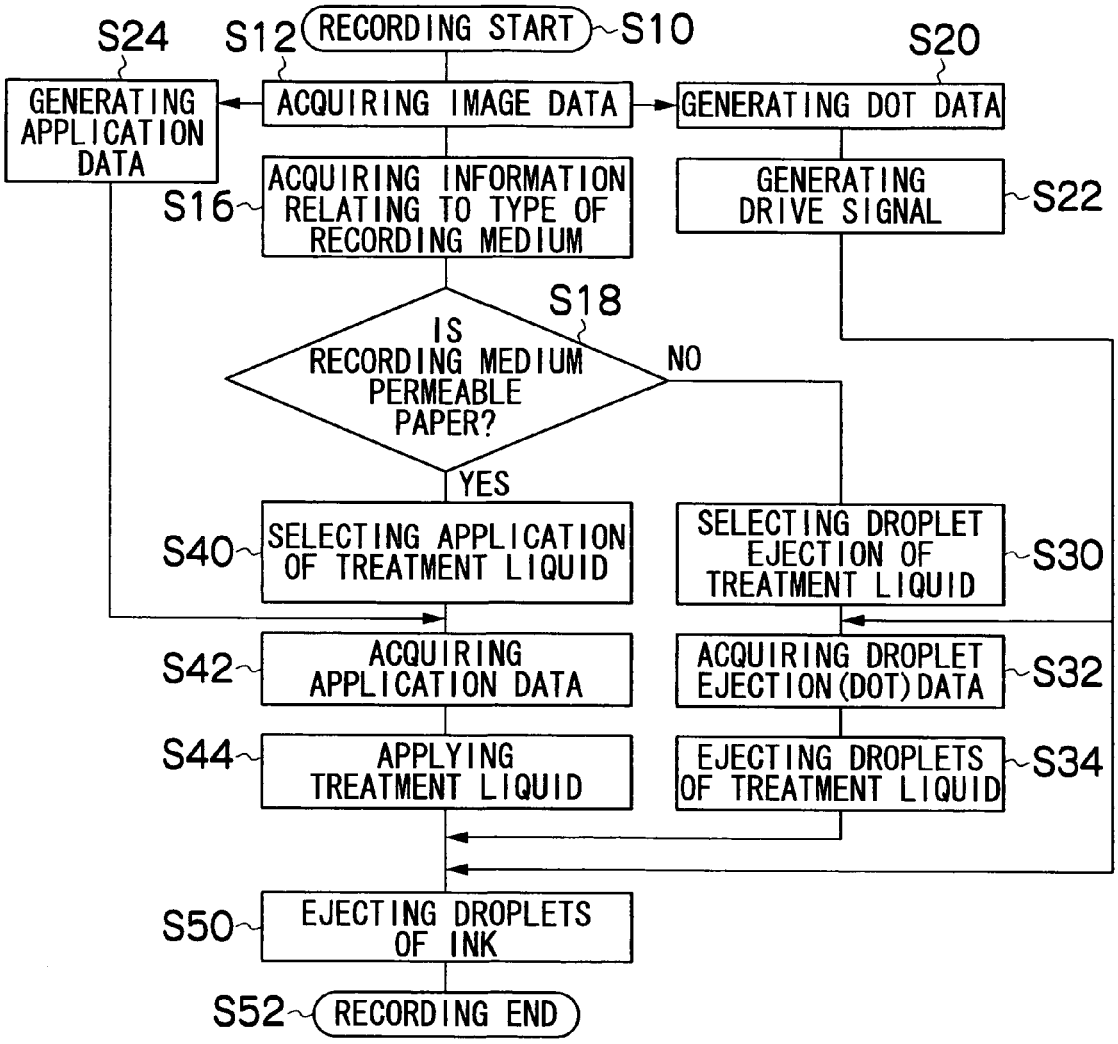
FIG. 7 is a flowchart showing sequence of a deposition control of the treatment liquid according to the first embodiment of the present invention.

FIG. 7 is a flowchart showing sequence of a treatment liquid deposition control according to the first embodiment of the present invention.

When image recording starts (step S10), image data (RGB data) relating to the image to be recorded is acquired (step S12), and dot data corresponding to the ink of respective colors (KCMY) and the treatment liquid S is generated (step S20). Then, the drive signals to be supplied to the respective heads 50 are generated according to the generated dot data (step S22). At the same time, treatment liquid S application data is generated from the image data acquired at step S12 (step S24).

On the other hand, when image data is acquired at step S12, information relating to the type of recording paper 16 (recording medium) is acquired (step S16), and then it is determined whether a permeable paper or a non-permeable paper is used as the recording paper 16 for recording the image, according to the information relating to the type of recording paper 16 (step S18).

The information relating to the type of recording paper may be obtained by reading information in the information recording medium attached to a magazine of rolled paper or a cassette in which cut paper is loaded, by means of a prescribed reading apparatus, thereby automatically identifying the used type of recording paper, or by means of the user indicating the information relating to the type of recording paper via a man-machine interface, such as a keyboard or touch panel (not shown). Furthermore, the recording paper 16 may be determined directly by using sensors (determination members) such as the print determination unit 24, so that the type of recording paper is determined (i.e., the information relating to the type of recording paper is acquired) according to the determination results.

If it is determined in the step S18 that the medium is a non-permeable medium (NO verdict), then the ejection method is selected for ejection the treatment liquid S onto the recording paper 16 by means of the treatment liquid ejection head 13 shown in FIG. 1 (step S30 in FIG. 7). Then, the treatment liquid ejection head 13 acquires the drive signal (droplet ejection data) generated at the step S22 (step S32), and ejects droplets of the treatment liquid S onto the recording paper 16 according to the droplet ejection data (step S34 in FIG. 7).

When droplets of treatment liquid S have been ejected at the step S34, then the procedure advances to step S50, ink droplets of the colors are ejected from the print heads 12K, 12C, 12M and 12Y according to the drive signals corresponding to the print heads 12K, 12C, 12M and 12Y. Thereby, a desired image is formed on the recording paper 16, and then the image recording process is terminated (step S52).

On the other hand, if it is determined in the step S18 that the recording paper 16 is permeable paper (YES verdict), then the application method is selected for applying the treatment liquid S by means of the treatment liquid application unit 19 shown in FIG. 1 (step S40 in FIG. 7). When the application data generated at the step S24 is acquired (step S42), the treatment liquid S is applied to the recording paper 16 by means of the treatment liquid application unit 19 (step S44). Then, when the procedure advances to the step S50, ink droplets of the colors are ejected from the print heads 12K, 12C, 12M and 12Y according to the image data. Thereby, a prescribed image is formed on the recording paper 16.

In the inkjet recording apparatus 10, the relationship between the types of recording media and the optimal deposition methods for the treatment liquid S is stored previously in the form of a data table in a memory (storage medium) such as the image buffer memory 82 shown in FIG. 6, so that an optimal deposition method for the treatment liquid S can be selected according to the type of recording paper, by referring to the data table.

In the inkjet recording apparatus 10 having the composition described above, the treatment liquid S deposition methods are switched selectively according to the type of recording paper 16, so that the treatment liquid application unit 19 is selected when permeable paper is used, and so that the treatment liquid ejection head 13 is selected when non-permeable paper is used. Therefore, an optimal amount of treatment liquid S can be deposited on the recording paper 16 in accordance with various types of media, and a desirable image can be formed without banding or non-uniformities caused by bleeding or landing interference, regardless of the type of recording paper 16.

In the present embodiment, a mode is described in which the deposition method for the treatment liquid S is selected according to the type of recording paper 16 (permeable/non-permeable paper); however, a composition may also be adopted in which the method of deposition of the treatment liquid S is selected according to the permeation speed (permeation duration) of the recording paper 16, instead of the type of recording paper 16. The permeation speed may be determined directly by using the print determination unit 24 shown in FIG. 1, or the like.

Second Embodiment

Next, a second embodiment of the present invention will be described. In the second embodiment, items which are the same as or similar to those in the first embodiment are labeled with the same reference numerals, and then description thereof is omitted here.

In the second embodiment, the object to be printed (the type of recorded image) is used as the aforementioned selection condition. In other words, when the object to be printed is figure, photograph, picture or the like, the treatment liquid S is applied to the recording paper 16 by means of the treatment liquid application unit 19. On the other hand, when the object to be printed is text or the like, the droplets of treatment liquid S are ejected toward the recording paper 16 by the treatment liquid ejection head 13.

Figure 8:
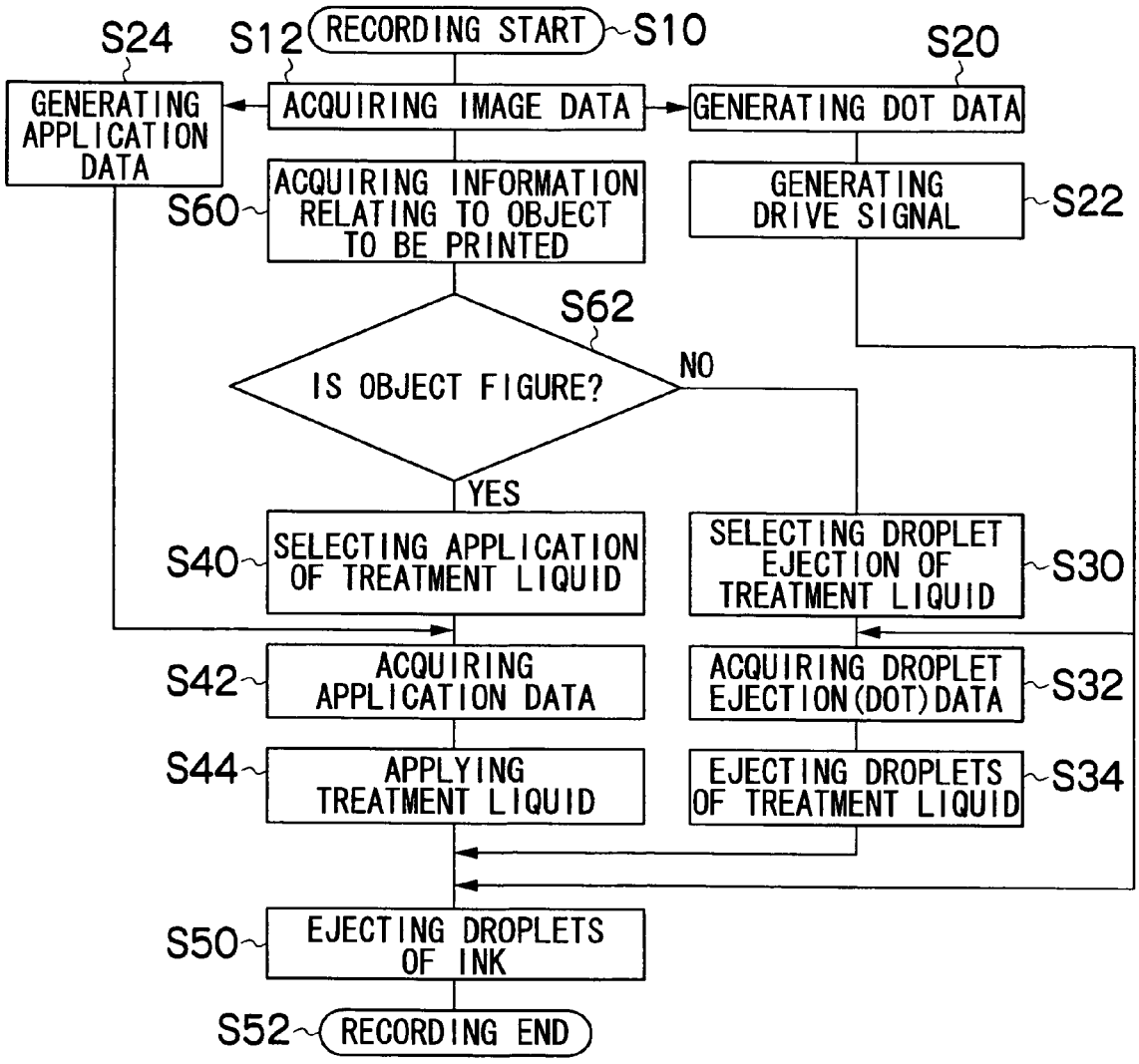
FIG. 8 is a flowchart showing sequence of the deposition control of the treatment liquid according to the second embodiment of the present invention.

FIG. 8 is a flowchart showing the sequence of control of the treatment liquid deposition method according to a second embodiment. In FIG. 8, items which are the same as or similar to those in FIG. 7 are labeled with the same reference numerals, and then description thereof is omitted here.

In this control sequence, instead of step S16 and step S18 shown in FIG. 7, information relating to the image to be printed (recorded) is acquired from the image data obtained at step S12 (step S60), and it is determined whether the image to be printed is a figure or text (document) (step S62).

If the object to be printed is text at the step S62 (NO verdict), then the ejection method is selected for ejecting the treatment liquid S toward the recording paper 16, by ejecting droplets of the treatment liquid S using the treatment liquid ejection head 13 shown in FIG. 1 (step S30 in FIG. 8). On the other hand, if the object to be printed is a figure (YES verdict), then the application data generated at step S24 is acquired (step S42), and treatment liquid S is applied to the recording paper 16 by the treatment liquid application unit 19 shown in FIG. 1 (step S44 in FIG. 8).

The object to be printed (contents of the recorded image) may be determined according to information contained in the image data (for example, the file format), or according to a specified print mode (high-quality print mode, high-speed print mode, or the like). Furthermore, information of the image to be printed may also be supplied directly by the user through a man-machine interface or the like.

In the inkjet recording apparatus 10 having the composition described above, the treatment liquid deposition methods are switched selectively in accordance with the objects to be printed, so that the treatment liquid application unit 19 is selected when printing a figure, photograph, or picture, and so that the treatment liquid ejection head 13 is selected when printing text. Therefore, an optimal amount of treatment liquid can be deposited on the recording paper 16 according to the type of object to be printed, and a desirable image can be recorded without banding or non-uniformities caused by bleeding or landing interference, regardless of the type of recording paper 16.

Third Embodiment

Next, a third embodiment of the present invention will be described. In the third embodiment, items which are the same as or similar to those in the first or second embodiment are labeled with the same reference numerals and description thereof is omitted here.

In the third embodiment, the ink droplet volume (ejection volume) is used as the aforementioned selection condition. More specifically, the required amount of treatment liquid S varies according to the ink droplet volume (ink ejection volume) V. In other words, when the ink droplet volume V increases, then the required amount of treatment liquid S increases. Therefore, the ink droplet volume V (pl) per unit surface area, which is determined according to the dot data, is compared with a threshold value Vth which has been established previously, and then the deposition method for the treatment liquid S is selected according to the comparison results.

When the treatment liquid S is applied to the recording paper 16 by the treatment liquid application unit 19, it is possible to deposit a greater amount of treatment liquid S on the recording paper 16, in comparison with the case in which droplets of the treatment liquid S are ejected by the treatment liquid ejection head 13.

Moreover, in the case in which there is no time to deposit the treatment liquid S by applying using the treatment liquid application unit 19, the treatment liquid ejection head 13 and the treatment liquid application unit 19 are used in combination, and hence it is possible to deposit a greater amount of treatment liquid S on the recording paper 16 in comparison with the case in which the treatment liquid S is applied by the treatment liquid application unit 19 alone.

In other words, depending on the decrease of the amount of treatment liquid S deposited on the recording paper 16, the deposition modes are switched in order of the combined use of application and droplet ejection, the use of application only, and the use of droplet ejection only.

In the present embodiment, three threshold values Vth1(P), Vth2(P) and Vth3(P) are set previously to switch selectively four methods: between the combined use of the droplet ejection of treatment liquid S and the application of treatment liquid S; the application of treatment liquid S; the droplet ejection of treatment liquid S; and no deposition of the treatment liquid S. Since the threshold values Vth can be changed suitably according to the type P of recording paper 16, the values Vth are taken as "Vth(P)". In this case, the aforementioned threshold values Vth1(P), Vth2(P) and Vth3(P) have the relationship: Vth1(P)>Vth2(P)>Vth3(P).

Figure 9:
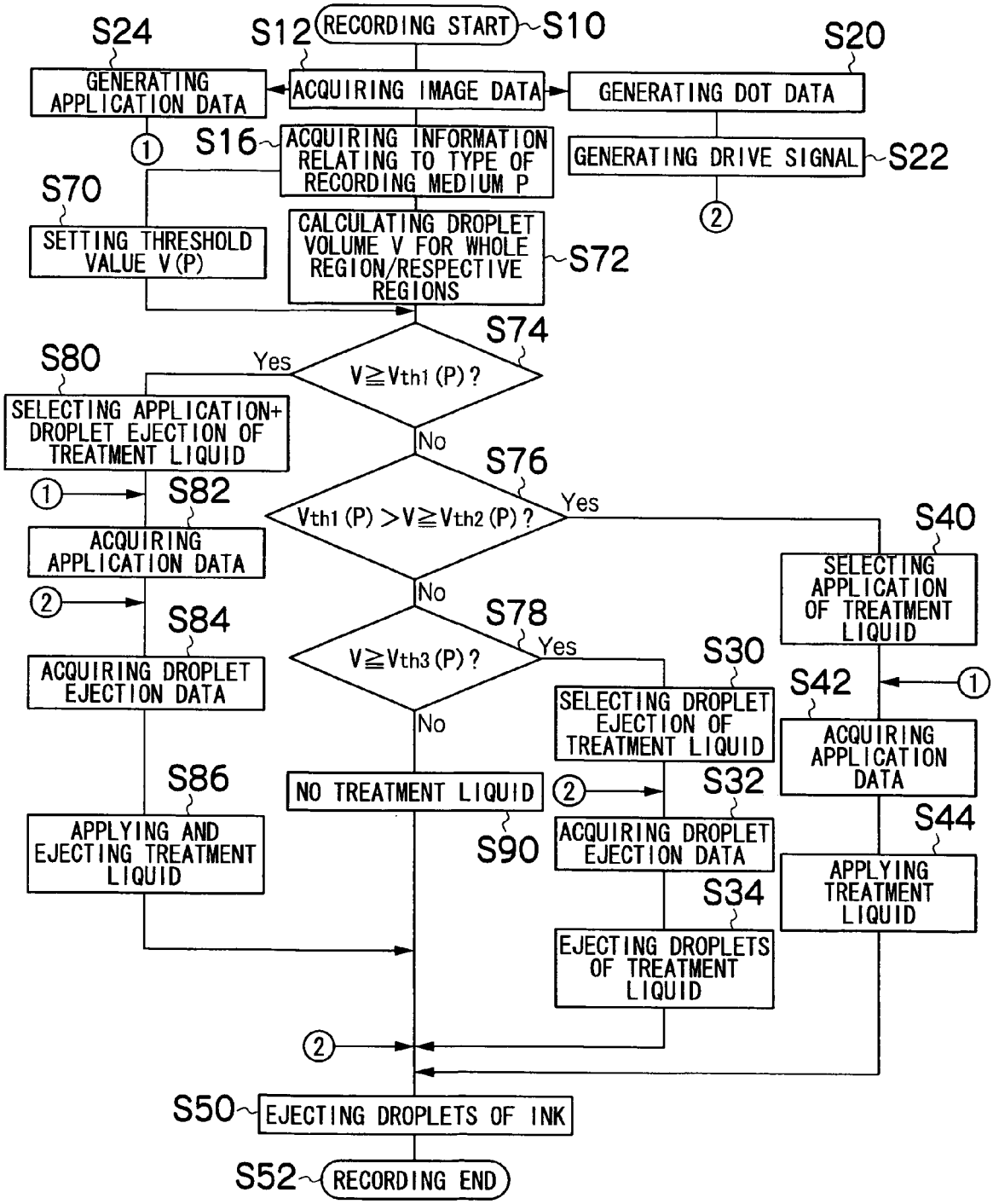
FIG. 9 is a flowchart showing sequence of the deposition control of the treatment liquid according to the third embodiment of the present invention.

FIG. 9 shows a flowchart of a deposition control of treatment liquid according to the third embodiment. In FIG. 9, items which are the same as or similar to those in FIG. 7 and FIG. 8 are labeled with the same reference numerals and description thereof is omitted here.

As shown in FIG. 9, when information on the type of recording paper 16 is acquired at step S16, then the procedure advances to a step 70, the threshold values Vth1(P), Vth2(P) and Vth3(P) are established. Then, the ink droplet volume V per unit surface area is calculated according to the image data (dot data) acquired at step S12 (step S72).

Figure 10:
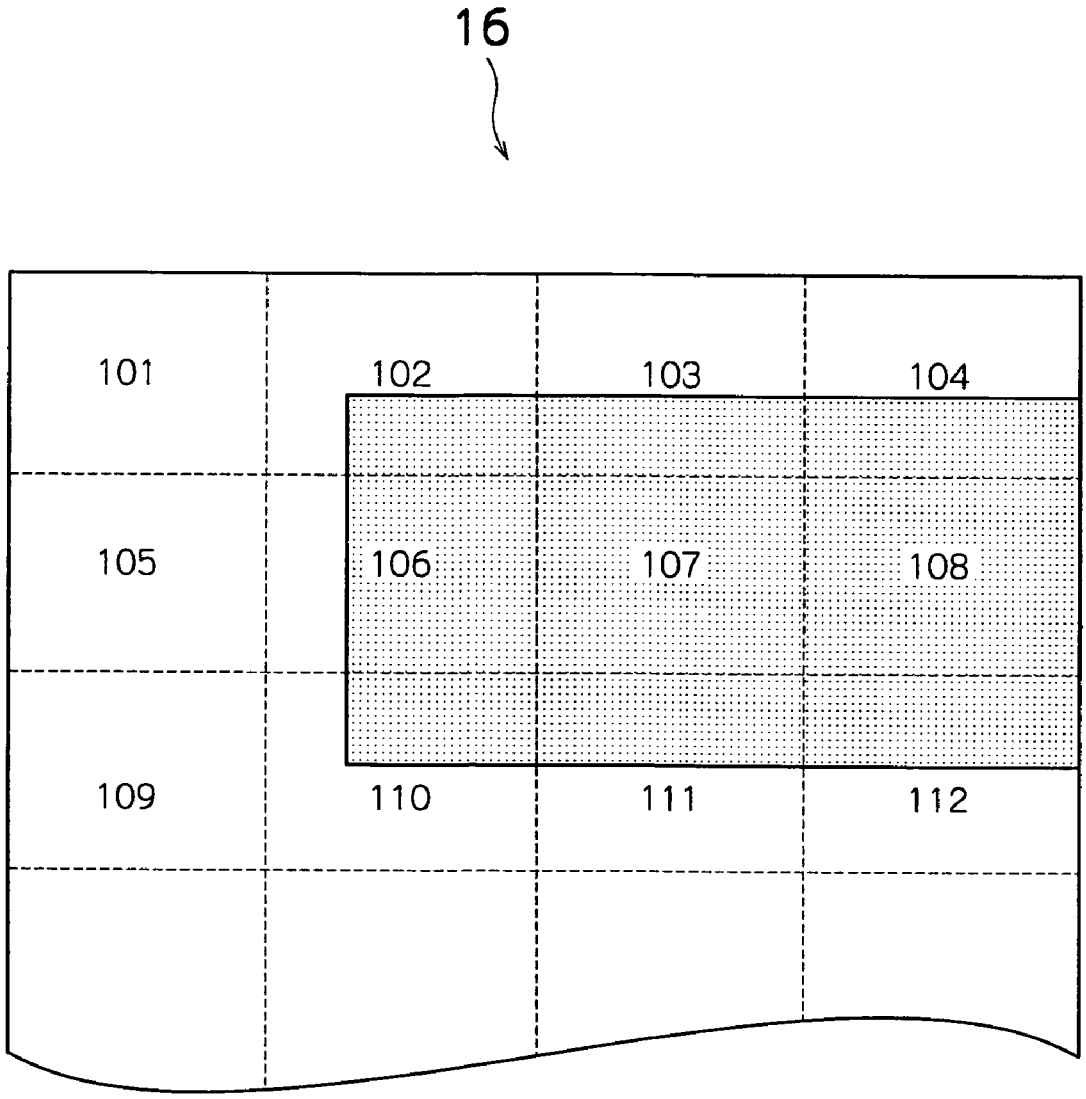
FIG. 10 is a diagram showing a mode in which the recording paper is divided into a plurality of regions.

The ink droplet volume V per unit surface area may be determined with respect to the entire region of recorded image (or the recording paper 16). Also, as shown in FIG. 10, it may be determined with respect to separate regions (denoted with reference numerals 101, 102, . . . , 112, . . . ) obtained by dividing the recorded image into a plurality of regions. If the ink droplet volumes V are determined respectively for the regions, then the aforementioned threshold values Vth1(P), Vth2(P) and Vth3(P) are established respectively for the regions.

In the mode in which the recorded image is divided into a plurality of regions, the recorded image may be divided after obtaining the image data in the step S12. Furthermore, image data corresponding to respective regions may be obtained after the recording paper 16 has been divided previously into a plurality of regions.

Thereupon, the procedure advances to a step S74, and the ink droplet volume V determined in the step S72 is compared with the threshold value Vth1(P) established in the step S70. At this time, if the comparison result of the step S74 becomes V≧Vth1(P) (YES verdict), then a method that combines the use of application by the treatment liquid application unit 19 shown in FIG. 1 and the use of droplet ejection by the treatment liquid ejection head 13 is selected as the method of deposition for the treatment liquid S (step S80 in FIG. 9).

When the combined use of application and droplet ejection is selected in the step S80, the application data generated in the step S24 is acquired (step S82), and then the droplet ejection data generated at step S22 is acquired (step S84). Then, the treatment liquid S is applied by the treatment liquid application unit 19, and the droplets of treatment liquid S are ejected from the treatment liquid ejection head 13 (step S86).

On the other hand, if the comparison result in the step S74 is V<Vth1(P) (NO verdict), then the procedure advances to a step S76, and the ink ejection volume V is compared with the threshold value Vth2(P). Then, if the comparison result in the step S76 becomes (Vth1(P)>) V≧Vth2(P) (YES verdict), then the procedure advances to the step S40, and application by the treatment liquid application unit 19 is selected as the deposition method for the treatment liquid S.

Furthermore, if the comparison result at step S76 becomes V<Vth2(P) (NO verdict), then the procedure advances to a step S78, and the ink droplet volume V is compared with the threshold value Vth3(P).

If the comparison result in the step S78 becomes (Vth2(P) >) V≧Vth3(P) (YES verdict), then the droplet ejection by the treatment liquid ejection head 13 is selected as the deposition method for the treatment liquid (step S30).

On the other hand, if the comparison result in the step S78 becomes V<Vth3(P) (NO verdict), then a process in which the treatment liquid S is not deposited on the recording paper 16 (no treatment liquid) is selected (step S90), and the ink droplets of the respective colors are ejected onto the recording paper 16 on which no treatment liquid S has been deposited, according to the droplet ejection data for the colors of ink generated in the step S22 (step S50).

In the case of selecting the droplet ejection of the treatment liquid S, or the combined use of droplet ejection of the treatment liquid S and application of the treatment liquid S, the droplet ejection density of the treatment liquid S can be varied in accordance with the ink droplet volume, so as to optimize the amount of treatment liquid S deposited on the recording paper 16.

Herein, general examples of an image in the respective cases, an image of V≧Vth1(P) is a solid image or the like, and an image of Vth1(P)>V≧Vth2(P) is a photographic image, picture or the like, except for a solid image. An image of Vth2(P)>V≧Vth3(P) is text, a line image or the like, and image of V<Vth3(P) is a white background (i.e., no image is formed).

As described above, since the amount of treatment liquid S deposited on the recording paper 16 is controlled in accordance with the ink droplet volume V, it is possible to deposit an optimal amount of treatment liquid S with respect to the ink droplet volume V. Therefore, the ink and the treatment liquid can be made to react together in a reliable fashion, and the amount of treatment liquid consumed can be restricted.

Adaptation Example

Next, an adaptation example of the first to third embodiments described above will be described. In this adaptation example, a deposition control of treatment liquid is described in the case in which the deposition controls of treatment liquid according to the first to third embodiments are combined together.

In the present adaptation example, when a text is recorded on a permeable paper, the droplet ejection by the treatment liquid ejection head 13 is selected. When a text is recorded on a non-permeable paper, the droplet ejection by the treatment liquid ejection head 13 is selected. In other words, regardless of the type of recording paper 16, the droplet ejection by the treatment liquid ejection head 13 is selected when a text is recorded.

Furthermore, when figures or the like are recorded onto a permeable paper, the application by the treatment liquid application unit 19 is selected. When figures or the like are recorded onto a non-permeable paper, at least one of the droplet ejection by the treatment liquid ejection head 13 and the application by the treatment liquid application unit 19 is selected in accordance with the contents of the figures or the like.

Figure 11:
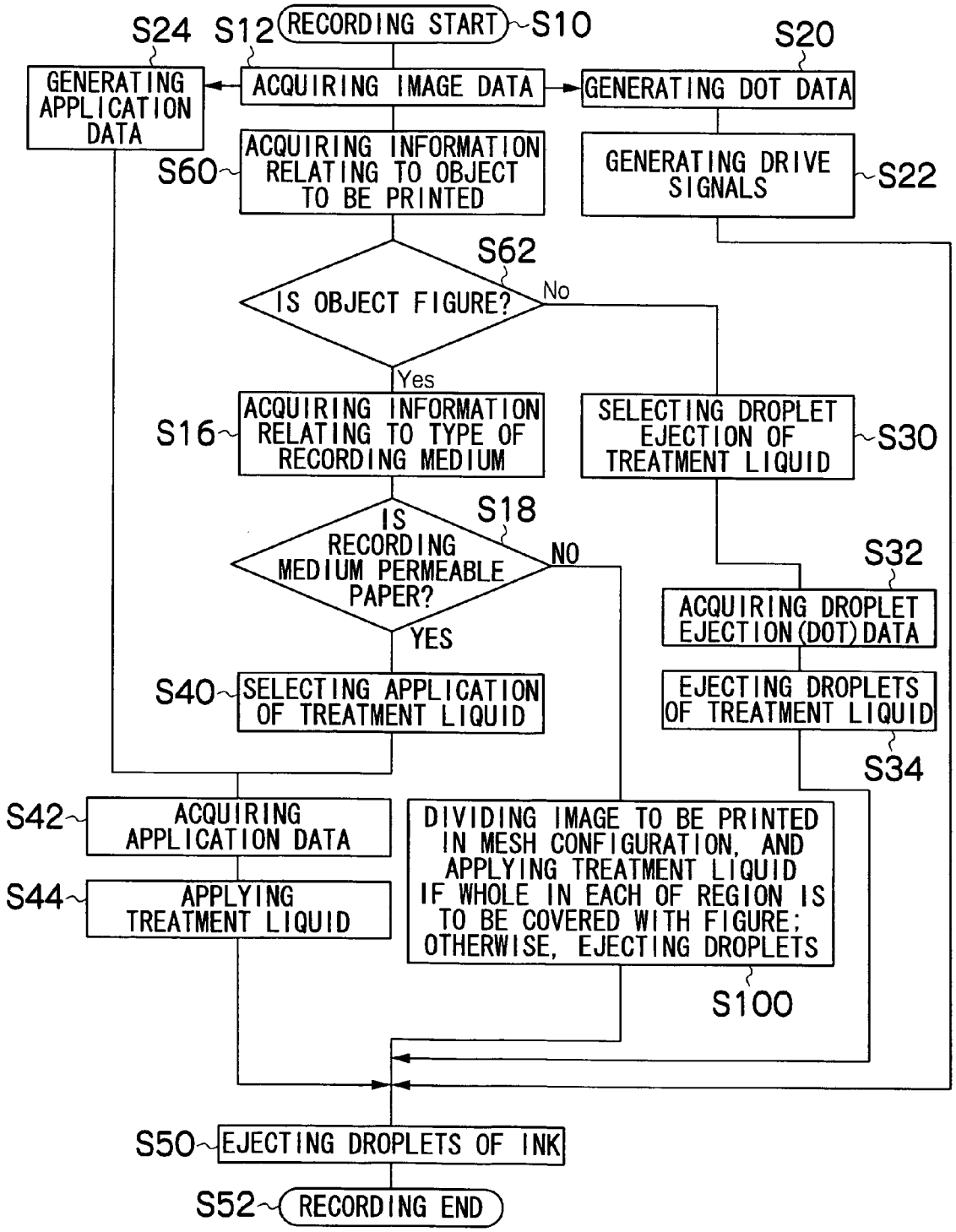
FIG. 11 is a flowchart showing an adaptation example of the deposition control of the treatment liquid according to the first and second embodiments of the present invention.

FIG. 11 shows a flowchart in a case of combining the deposition controls of treatment liquid S according to the first and second embodiments.

In the mode shown in FIG. 11, when image data is acquired at the step S12, the deposition method for the treatment liquid S is selected according to the object to be printed as described previously in the second embodiment. In other words, in the step S62, it is determined whether or not the object to be printed is a figure. If the object is not a figure (NO verdict), then droplets of the treatment liquid S are ejected by the treatment liquid ejection head 13 (step S30).

On the other hand, if it is determined that the object to be printed is a figure in the step S62 (YES verdict), then the procedure advances to the step S16. Then, information on the type of recording paper 16 is obtained, and it is determined whether the recording paper 16 is a permeable paper or a non-permeable paper (step S18).

At this time, if the recording paper 16 is a permeable paper (YES verdict), then application of the treatment liquid S by the treatment liquid application unit 19 is selected (step S40). If the recording paper 16 is a non-permeable paper (NO verdict), then the procedure advances to a step S100.

In the step S100, as shown in FIG. 10, a plurality of regions 101, 102, . . . , are set into the recorded image (by dividing in a mesh configuration), and the image contents are determined for each region. In the example shown in FIG. 10, an image is recorded in the region shaded. In the regions other than this, either a text or nothing is recorded.

If an image is formed throughout the whole of region as shown in the regions 107 and 108, then the application of the treatment liquid S by the treatment liquid application unit 19 is selected. In the case of the regions other than those, the ejection of droplets of treatment liquid S by the treatment liquid ejection head 13 is selected. It is also possible to adopt a composition in which the no deposition of the treatment liquid S is selected when an image is not recorded in the whole of a region contained in the regions that the droplet ejection by the treatment liquid ejection head 13 is selected.

When the treatment liquid S is deposited on the desired regions of the recording paper 16, the procedure advances to the step S50, and then the ink droplets of the respective colors are ejected.

When a figure is recorded within the regions 102 to 104, 106, and 110 to 112 where the text and figures and the like are combined, it is preferable that the droplet density of treatment liquid S ejected from the treatment liquid ejection head 13 is controlled at a high density.

Description of treatment liquid

As the treatment liquid S adopted in the inkjet recording apparatus 10, it is possible to use a liquid based on commonly known materials. For example, the aforementioned materials include a cationic polymer (polyallylamine, polyamine sulfone, polyvinylamine, chitosan, and neutralized products thereof), or an anionic polymer (polyacrylate, shellac, styrene-acrylate copolymer, styrene-maleic anhydride copolymer, or the like). The treatment liquid S may also comprise a solvent (water), surfactant, moisturizing agent, coloring material aggregating agent (pH adjuster (acid) or multivalent metallic salt), or the like.

Furthermore, the inks of colors are composed of a solvent (water), coloring material (pigment or dye), surfactant, moisturizing agent, anionic polymer, and the like.

The inkjet recording apparatus 10 has two types of members for depositing the aforementioned treatment liquid S on the recording paper 16. The treatment liquid S1 ejected from the treatment liquid ejection head 13, and the treatment liquid S2 applied by the treatment liquid application unit 19 may have properties different from each other.

More specifically, the treatment liquid S1 and the treatment liquid S2 may be composed to have the same reactive characteristics (contents) but different densities (density and volume of reactive material), so that the density of the treatment liquid S2 is greater than the density of the treatment liquid S1. In other words, the treatment liquid S1 and the treatment liquid S2 satisfies the following relationship:

density of treatment liquid S1<density of treatment liquid S2.

In this case, it is possible to react with a large amount of ink by increasing the density of the treatment liquid S (in other words, it is possible to improve the reaction efficiency with respect to the ink). Furthermore, the higher the viscosity of the treatment liquid S, the longer the permeation time of the treatment liquid into the recording paper 16. In particular, when using a permeable paper, it is preferable that the treatment liquid S has high viscosity, so that a time period can be ensured between deposition of the treatment liquid S on the recording paper 16 and ejection of the ink droplets (ink landing time).

On the other hand, when the viscosity of the treatment liquid S is increased by raising the density of the reactive material, it becomes more difficult to eject the treatment liquid from the treatment liquid ejection head 13. When a treatment liquid of high viscosity is ejected from the treatment liquid ejection head 13, the ejection abnormalities are liable to occur, such as ejection failures where no treatment liquid is ejected, ejection volume abnormalities, and ejection position abnormalities. Therefore, it may become impossible to eject droplets of treatment liquid S of the desired volume at the desired positions, and banding, non-uniformities, and the like, occur in the recorded image, due to bleeding and landing interference.

In this case, preferably, a treatment liquid S (S2) having a high density (viscosity) is applied to the recording paper 16 by the treatment liquid application unit 19, and a treatment liquid S (S1) having low density (viscosity) is ejected toward the recording paper 16 from the treatment liquid ejection head 13 in the form of droplets.

Furthermore, the treatment liquid S1 and the treatment liquid S2 may also have different surface tensions. By increasing the amount of surfactant contained in the treatment liquid S, it is possible to reduce the surface tension. When the surface tension of the treatment liquid S is high, the treatment liquid S forms round droplets on the recording paper 16, and hence it becomes difficult to deposit the treatment liquid S on the recording paper 16 in a uniform manner. Therefore, it is preferable to reduce the surface tension of the treatment liquid S, so that the treatment liquid S can be deposited on the recording paper 16 uniformly.

In this way, the treatment liquids S having different properties (such as density, viscosity, surface tension, and the like) can be deposited reliably in accordance with selection conditions by the combined use of two types of members. Furthermore, since an optimal amount of treatment liquid S can be deposited on the recording paper 16, it is possible to restrict the consumption of treatment liquid.

In the present example, the densities of the treatment liquids S are changed by altering the amounts of the reactive material contained in the treatment liquids S1 and S2, without changing the composition of the reactive materials. However, the densities of the treatment liquids S also can be changed by altering the composition of the reactive materials contained in the treatment liquids S1 and S2.

Furthermore, the present example is the mode in which the treatment liquid ejection head 13 and the treatment liquid application unit 19 are provided on the upstream side of the printing unit 12 in the paper conveyance direction, but it is also possible to provide a treatment liquid deposition device having a treatment liquid ejection head 13 and a treatment liquid application unit 19 on the upstream side of the printing unit 12 in the paper conveyance direction. Moreover, a treatment liquid removing device which removes residual treatment liquid from the recording paper 16 after ejection of ink droplets (after fixing of the ink) may be provided on the downstream side of the printing unit 12 in the paper conveyance direction.

The present embodiment described an inkjet recording apparatus 10 for forming images on a recording paper 16 by ejecting ink from nozzles provided in a print head, but the scope of application of the present invention is not limited to those. It may also be applied broadly to image forming apparatuses which form images (three-dimensional shapes) by means of a liquid other than ink, such as resist, or to liquid ejection apparatuses, such as dispensers, which eject liquid chemicals, water, or the like, from nozzles (ejection apertures).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an ink ejection head which forms a desired image by ejecting ink toward a recording medium;

a treatment liquid ejection head that ejects a first treatment liquid on to the recording medium, the first treatment liquid reacting with the ink on the recording medium;

a treatment liquid application device that applies a second treatment liquid to the recording medium when the treatment liquid application device is in contact with the recordinag medium, the second treatment liquid reacting with the ink on the recording medium; and control device which controls the treatment liquid ejection head and the treatment liquid application device so that at least one of the treatment liquid ejection head and the treatment liquid application device is operative to supply their respective first and second treatment liquids to the recording medium.

2. The inkjet recording apparatus as defined in claim 1, further comprising a recording medium determination device which determines a type of the recording medium, wherein the control device is responsive to the type of the recording medium determined by the recording medium determination device so as to control the supplying of the at least one of the first treatment liquid by the treatment liquid ejection head and the second treatment liquid by the treatment liquid application device.

3. The inkjet recording apparatus as defined in claim 1, further comprising an image content determination device which determines a content of the image to be formed on the recording medium, wherein the control device is responsive to the content of the image determined by the image content determination device so as to control the supplying of the at least one of the first treatment liquid by the treatment liquid ejection head and the second treatment liquid by the treatment liquid application device.

4. The inkjet recording apparatus as defined in claim 1, further comprising an ink ejection volume determination device which determines a volume of the ink to be ejected toward the recording medium, wherein the control device is responsive to the volume of the ink determined by the ink ejection volume determination device so as to control the supplying of the at least one of the first treatment liquid by the treatment liquid ejection head and the second treatment liquid by the treatment liquid application device.

5. The inkjet recording apparatus as defined in claim 1, further comprising a region setting device which sets a plurality of regions into the recording medium, wherein the control device is responsive to the regions set by the region setting device so as to control the supplying of the at least one of the first treatment liquid on to a given set region of the recording medium by the treatment liquid ejection head and the second treatment liquid by the treatment liquid application device.

6. The inkjet recording apparatus as defined in claim 1, wherein a property of the first treatment liquid ejected by the treatment liquid ejection head is different from a property of the second treatment liquid applied by the treatment liquid application device.

7. The inkjet recording apparatus as defined in claim 6, wherein the different property of the first and second treatment liquids include at least one of a density of a reactive material contained in the first and second treatment liquids, a viscosity of the reactive material contained in the first and second treatment liquids, and a surface tension of the first and second treatment liquids.

8. The inkjet recording apparatus as defined in claim 7, wherein the density of the second treatment liquid applied by the treatment liquid application device is greater than the density of the first treatment liquid ejected by the treatment liquid ejection head.

9. The inkjet recording apparatus as defined in claim 7, wherein the viscosity of the second treatment liquid applied by the treatment liquid application device is greater than the viscosity of the first treatment liquid ejected by the treatment liquid ejection head.

10. The inkjet recording apparatus as defined in claim 7, wherein the surface tension of the first treatment liquid ejected by the treatment liquid ejection head is greater than the surface tension of the second treatment liquid applied by the treatment liquid application device.

11. The inkjet recording apparatus as defined in claim 1, wherein the first and second treatment liquids are identical.

12. The inkjet recording apparatus as defined in claim 1, further comprising a conveyance device which conveys the recording medium and the ink ejection head relatively to each other in a conveyance direction, wherein the treatment liquid application device includes a plurality of application rollers which apply the second treatment liquid to the recording medium, the plurality of application rollers being arranged so as to overlap with each other in a direction substantially perpendicular to the conveyance direction.

13. The inkjet recording apparatus as defined in claim 12, wherein the plurality of application rollers are arranged so as to cover an entire surface of the recording medium.

14. The inkjet recording apparatus as defined in claim 1 wherein:

when the recording medium is a non-permeable medium, the control device controls the treatment liquid ejection head to eject the first treatment liquid on to the recording medium; and when the recording medium is a prameable medium, the control device controls the treatment liquid application device to apply the second treatment liquid to the recording medium.

15. The inkjet recording apparatus as defined in claim 1, wherein:

when the desired image is a text image, the control device controls the treatment liquid ejection head to eject the first treatment liquid on to the recording medium; and when the desired image is a figure image, the control device controls the treatment liquid application device to apply the second treatment liquid to the recording medium.

16. An inkjet recording apparatus, comprising:

ink ejection means for forming a desired image by ejecting ink toward a recording medium;

first means for ejecting a first treatment liquid toward the recording medium, the first treatment liquid reacting with the ink on the recording medium;

a second means for applying a second treatment liquid to the recording medium when the second means is in contact with the recording medium, the second treatment liquid reacting with the ink on the recording medium; and a control means for controlling the first means and the second means so that at least one of the first means and the second means are made operative to supply a corresponding first treatment liquid and second treatment liquid to the recording medium.

17. The inkjet recording apparatus as defined in claim 16, wherein the first treatment liquid and the second treatment have like properties.

18. The inkjet recording apparatus as defined in claim 16, wherein the first treatment liquid and the second treatment have at least one different property.

19. The inkjet recording apparatus as defined in claim 16, wherein the control means is responsive to at least one of means for detecting a type of recording medium, means for detecting a content of the image to be formed on the recording medium, means for detecting a volume of the ink to be ejected toward the recording medium, and regions set by a region setting means for controlling the first means and the second means.

* * * * *